US005906481A

United States Patent [19]

Ogawa et al.

[11] Patent Number: 5,906,481

[45] Date of Patent: May 25, 1999

[54] PIEZOELECTRIC FLUID PUMP

[75] Inventors: Kazuki Ogawa; Yuji Yoshida; Motoyuki Nishizawa; Nobuo Kamehara, all of Kawasaki; Akio Yano, Inagi; Akihiko Miyaki, Inagi; Masahiro Ono, Inagi; Yasuo Numata, Kawasaki; Kazuaki Kurihara, Kawasaki; Keiji Watanabe, Kawasaki, all of Japan

[73] Assignees: Fujitsu Limited, Kanagawa; Fujitsu Isotec Limited, Tokyo, both of Japan

[21] Appl. No.: 08/651,556

[22] Filed: May 22, 1996

[30] Foreign Application Priority Data

May 23, 1995 [JP] Japan ..... 7-123959
Mar. 19, 1996 [JP] Japan ..... 8-063269

[51] Int. Cl.[6] ..... F04B 17/00

[52] U.S. Cl. ..... 417/413.2; 417/322

[58] Field of Search ..... 417/322, 413.2

[56] References Cited

U.S. PATENT DOCUMENTS

| | | | |
|---|---|---|---|
| 4,216,477 | 8/1980 | Matsuda et al. | 417/413.3 |
| 4,752,788 | 6/1988 | Yasuhara et al. | 417/322 |
| 4,842,493 | 6/1989 | Nilsson | 417/322 |
| 4,938,742 | 7/1990 | Smits | 417/413.2 |

FOREIGN PATENT DOCUMENTS

| | | |
|---|---|---|
| 62-294556 | 12/1987 | Japan . |
| 63-129173 | 6/1988 | Japan . |
| 3-272855 | 12/1991 | Japan . |
| 4-64448 | 2/1992 | Japan . |
| 4-341853 | 11/1992 | Japan . |
| 5-169657 | 7/1993 | Japan . |
| 6-188475 | 7/1994 | Japan . |

*Primary Examiner*—Charles G. Freay
*Attorney, Agent, or Firm*—Armstrong, Westerman, Hattori, McLeland & Naughton

[57] ABSTRACT

A piezoelectric fluid pump includes a stationary pump base and a plurality of piezoelectric elements arranged in parallel on the stationary pump base, each of the piezoelectric elements having, in a polarizing direction thereof or in a direction perpendicular to the polarizing direction, a first end fixed to the stationary pump base and a free, second end. The free, second ends of respective pairs of adjacent the piezoelectric elements are connected to each other, for respective units of the fluid pump. Between the pair of piezoelectric elements and between the stationary pump base and the connecting means, pressure chambers are defined. There are gaps are between walls of the piezoelectric elements and walls of piezoelectric elements of adjacent units.

18 Claims, 31 Drawing Sheets

PIEZOELECTRIC FLUID PUMP

BACKGROUND OF THE INVENTION

1. Field of the Invention

The present invention relates to a fluid pump from which fluid is discharged by utilizing the deformation of a piezoelectric body, and also relates to a manufacturing method of the fluid pump. This fluid pump is referred to as a piezoelectric pump in this specification, hereinafter.

This type piezoelectric pump is useful when a minute quantity of fluid is accurately conveyed or a minute quantity of fluid is controlled so that it can be accurately discharged from the pump. However, in an ink jet type printer which is a typical example to which the piezoelectric pump is applied, a bubble jet type printer using heated vapor is evaluated to be more economical and compact than a printer in which the piezoelectric type pump is used. However, as compared with the bubble jet type printer in which a heating means is used for generating vapor pressure, the piezoelectric type pump is superior from the viewpoint of energy efficiency. Accordingly, it has been desired to make the piezoelectric pump compact 2. Description of the Related Art An amount of deformation of the piezoelectric element is very small. Therefore, when the piezoelectric element is put into practical use, an amplifying mechanism to amplify the deformation is used together with the piezoelectric element in many cases. A bimorph is a typical amplifying mechanism to amplify a displacement. In an amplifying section of the bimorph or other mechanisms, the rigidity is insufficient, so that the frequency characteristic is deteriorated and the speed of response is lowered. This problem is a factor to deteriorate the competitive power of the fluid pump in which the piezoelectric element is used. In order to increase the rigidity of the amplifying mechanism to amplify a displacement, concerning the oscillation mode, it is preferable to adopt an oscillation mode in the longitudinal oscillating direction.

With respect to the deformation of a piezoelectric body, the polarizing direction is referred to as $d_{33}$, and a direction perpendicular to the polarizing direction is referred to as $d_{31}$. When voltage E is applied in the polarizing direction and the thickness in the polarizing direction is represented by t, the electric field is represented by E/t. In the case where no load is given, the deformation in the thickness direction (the polarizing direction) caused by the electric field E/t is expressed as follows.

$$(E/t)\times d_{33}\times t=Ed_{33}$$

Therefore, the deformation is irrespective of the thickness t. On the other hand, in the direction of $d_{31}$, when the length in the direction perpendicular to the thickness direction is represented by L, the deformation in the direction perpendicular to the thickness direction is expressed as follows.

$$(E/t)\times d_{31}\times L$$

As shown in the above expression, it is possible to provide a large amount of deformation when L/t is appropriately selected.

An amount of the deformation $d_{33}$ in the polarizing direction is substantially twice as large as that of the normal deformation $d_{31}$. In the case of a piezoelement, the amount of the deformation $d_{33}$ in the polarizing direction is approximately $600\times10^{-12}$ m/V. However, due to the restriction of a semiconductor provided in the drive circuit, only several tens voltage is allowed for the deformation in the polarizing direction. Accordingly, an amount of the obtained displacement is only 0.0X $\mu$m, so that the design of the device is difficult. In order to solve the above problem, an amplifying mechanism including a bimorph is employed, or alternatively a value of L/t is increased in the direction of $d_{31}$ in the process of designing. However, even if the above countermeasure is taken, it is impossible to avoid a problem of slow speed of response.

When a high voltage is provided by a method in which a transformer is used, the circumstances are different, and it is possible to obtain a predetermined amount of displacement without using an amplifying mechanism.

Concerning the mechanism by which fluid is given pressure without using an amplifying mechanism, the simplest method is to dip a piezoelectric body in fluid as it is so that a change in the volume of the piezoelectric body is directly transmitted to fluid. This technique is disclosed in the U.S. Pat. No. 4,752,788. However, the piezoelectric body is deformed in such a manner that the piezoelectric body is contracted in the direction of $d_{31}$ when the piezoelectric body is elongated in the direction of $d_{33}$. Accordingly, an overall change in the volume is small. Japanese Unexamined Patent Publication (Kokai) No. 4-341835 is based on the concept that it is difficult to obtain a practical amount of contraction unless a large amount of deformation is provided by impressing a low voltage even in the case of a laminated piezoelectric body.

Japanese Unexamined Patent Publication (Kokai) No. 5-169657 discloses an arrangement in which pressure of fluid is raised and lowered when a piezoelectric body pushes a pressure chamber from the outside. However, in order to obtain a larger amount of displacement, a design is put into practical use, in which a value of L/t is increased using a displacement in the direction of $d_{31}$.

SUMMARY OF THE INVENTION

An object of the present invention is to provide a piezoelectric pump, the efficiency of which is more enhanced by utilizing both the deformation of a piezoelectric body in the polarizing direction of $d_{33}$ and the deformation of a piezoelectric body in the direction of $d_{31}$ which is perpendicular to the polarizing direction.

Another object of the present invention is to provide a piezoelectric pump in which the piezoelectric body is previously compressed so that a high tensile stress is not given to the piezoelectric body in its operating range.

Still another object of the present invention is to provide a piezoelectric pump, the overall arrangement of which is simple so that it can be easily manufactured.

According to the present invention, there is provided a piezoelectric fluid pump comprising: a stationary pump base; a flexible wall; a piezoelectric element having, in a polarizing direction thereof, a first end fixed to the stationary pump base and a second, free end connected to the flexible wall; and means for defining a pressure chamber including the stationary pump base, the flexible wall and the piezoelectric element.

The piezoelectric element is integrally fixed, at the first end thereof, to the stationary pump base, a first electrode is provided, at the first end, on the stationary pump base at an outside of the pressure chamber and a second electrode is provided on the second end of the piezoelectric element.

At least a part of the flexible wall is made of conductive material which constitutes the second electrode.

The flexible wall may be provided with a fluid inlet port and a fluid outlet port which are communicated to the pressure chamber.

The flexible wall comprises a metal film which can be plastically machined or formed by an electric plating process.

The outlet port of the flexible wall may be tapered.

The flexible wall is provided with a thin wall portion or a corrugated portion between connecting portions to which the stationary pump base and the piezoelectric element are connected to the flexible wall, respectively, to give the wall flexibility.

A plurality of units are arranged in parallel, each of the units comprises an integral piezoelectric body which includes the piezoelectric element and a partition space for partitioning the pressure chamber from a pressure chamber of an adjacent unit.

According to another aspect of the present invention, there is provided a piezoelectric fluid pump comprising: a stationary pump base; a pair of piezoelectric elements arranged on the stationary pump base, each of the piezoelectric elements having, in a polarizing direction thereof or in a direction perpendicular to the polarizing direction, a first end fixed to the stationary pump base and a free, second end; a connecting means for connecting the free, second ends of the pair of piezoelectric elements to each other; and means for defining a pressure chamber including the stationary pump base, the pair of piezoelectric elements, and the connecting means.

The pressure chamber defining means comprises a unitary piezoelectric block having grooves which are formed by mechanical process, such as slit-machining process, or extrusion molding process.

According to still another aspect of the present invention, there is provided a piezoelectric fluid pump comprising: a stationary pump base; a plurality of piezoelectric elements arranged in parallel on the stationary pump base, each of the piezoelectric elements having, in a polarizing direction thereof or in a direction perpendicular to the polarizing direction, a first end fixed to the stationary pump base and a free, second end; connecting means for connecting the free, second ends of respective pairs of adjacent the piezoelectric elements to each other, for respective units of the fluid pump; and means for defining pressure chambers, each defined between the pair of piezoelectric elements and between the stationary pump base and the connecting means, so that there are gaps are between walls of the piezoelectric elements and walls of piezoelectric elements of adjacent units.

The stationary pump base and the plurality of piezoelectric elements are formed of a unitary piezoelectric block; first, inner electrodes are provided on inner surfaces of the pair of piezoelectric elements, between which the pressure chamber is defined, and second, outer electrodes are provided on outer surfaces of the pair of piezoelectric elements; the second, outer electrodes are formed by depositing conductive thin films on inner surfaces of the gaps; and the piezoelectric block is provided with intermediate slits for electrically isolating the second, outer electrodes of a certain unit from second, outer electrodes of adjacent units.

The piezoelectric block has at least one end surface, on which transverse slit is provided along a direction perpendicular to the intermediate slits; at least the inner surfaces of the gaps and the end surface of the piezoelectric block are plated with the conductive thin film; the end surface of the piezoelectric block is polished so that the plated thin conductive film thereon is removed, thus the first, inner electrodes are electrically isolated from the second, outer electrodes on outer walls of the pair of piezoelectric elements; and the second, outer electrodes of the pair of piezoelectric elements, between which the pressure chamber is defined, are electrically connected to each other through the plated thin conductive film formed in the transverse slit.

The piezoelectric block is provided, between adjacent units, with the gaps which are also formed by mechanical process, such as slit-machining process, or extrusion molding process.

The gaps defined between adjacent units are filled with elastic material.

In one embodiment, a first, inner electrode is provided on an inner surface of at least one of the pair of piezoelectric elements, between which the pressure chamber is defined, and a second, outer electrode is provided on outer surface of the at least one of the pair of piezoelectric elements; and the first or second electrode is electrically connected to corresponding electrodes of adjacent units.

In another embodiment, a first, inner electrode is provided on inner surfaces of the pair of piezoelectric elements, between which the pressure chamber is defined, and a second, outer electrode is provided on outer surfaces of the pair of piezoelectric elements; and material of the first and second electrodes are different to each other. A thickness of the first electrode may be different from a thickness of the second electrode.

The first electrode is relatively rigid material, such as a metal plate coated on the inner surfaces of the pair of piezoelectric elements, and the second electrode is relatively deformable material, such as a conductive paste filled in the gaps.

A piezoelectric block is subjected to slit-machining process or shape-extrusion molding process to form a plurality of units of the piezoelectric fluid pump including a plurality of grooves constituting the pressure chambers and the a plurality of the gaps alternately arranged; and closing members are adjoined to respective ends of the piezoelectric block to form closed pressure chambers.

A piezoelectric block is subjected to slit-machining process or shape-extrusion molding process to form a plurality of units of the piezoelectric fluid pump including a plurality of thin grooves which constitute the pressure chambers and a plurality of the gaps alternately arranged; and free ends of piezoelectric elements which constitute walls of the thin grooves are covered by a plate member having fluid outlet ports or inlet ports.

According to a further aspect of the present invention, there is provided a piezoelectric fluid pump comprising: a stationary pump base; a plurality of piezoelectric elements arranged on the stationary pump base, each of the piezoelectric elements having, in a polarizing direction thereof or in a direction perpendicular to the polarizing direction, a first end fixed to the stationary pump base and a free, second end; a connecting means for connecting the free, second ends of adjacent the piezoelectric elements to each other; means for defining closed chambers constituting pressure chambers for respective units between adjacent the piezoelectric elements and between the stationary pump base and the connecting means; the pressure chambers of respective units are partitioned with respect to a pressure chamber of an adjacent unit by a single wall of the piezoelectric element; respective piezoelectric elements of the both sides of the pressure chamber are simultaneously driven to change thickness thereof, but fluid suction and injection are not operated in the pressure chambers of the adjacent units.

A controlling means is provided to drive the pressure chambers in such a manner that, when the pressure chamber in a certain unit is driven, walls of piezoelectric elements in the adjacent two units arranged opposite to the certain unit are operated to be deformed in the reverse direction, so that the volume changes of the pressure chambers in the adjacent two units are cancelled.

The drive controlling means comprises means for driving the pressure chambers for each three units or for each odd number of units, so that the drive order are shifted in turn.

A piezoelectric block has a plurality of grooves are arranged side by side in parallel, the grooves are partitioned by a wall provided at the intermediate portion of the grooves, the pressure chambers of the respective units are defined in the partitioned grooves alternately in the direction of the grooves and in the direction perpendicular to the grooves.

First and second electrodes are provided on respective surfaces of each piezoelectric element; and a product of a distributed resistance of the electrodes and a distributed capacitance of the piezoelectric element substantially equal to a pressure propagation velocity of a fluid in the pressure chamber.

First and second electrodes are provided on respective surfaces of each piezoelectric element; and an additional capacitance is provided in the piezoelectric element so as to be parallel to the electrodes to compensate a product of a resistance of the electrode and a capacitance of the piezoelectric element.

The piezoelectric elements arranged adjacent to each other are provided in the vicinity of the free, second end thereof with thin layers having high dielectric constant so as to constitute a part of inner wall of the pressure chamber.

According to a still further aspect of the present invention, there is provided a process for making a piezoelectric fluid pump comprising, the process comprising the following steps of: coating a first metal layer on a surface of a piezoelectric body; covering the first metal layer with,a removable material which can be subsequently removed; forming a second metal layer on the material; forming a groove, by mechanically cutting, through the second metal layer, the material, the first metal and a part of the piezoelectric body; forming a metal film on a surface including the groove formed by mechanical cutting; and removing the removable material to define a space for a pressure chamber between the first and second metal layers which constitute first and second electrodes, respectively.

According to yet further aspect of the present invention, there is provided a piezoelectric fluid pump comprising: means for defining a longitudinal pressure chamber; the pressure chamber means having a nozzle port at a first end of the pressure chamber and an fluid inlet port at a second end of the pressure chamber communicated to a common ink chamber; the pressure chamber defining means comprising a piezoelectric element which constitutes at least a part of wall of the pressure chamber; means for driving the piezoelectric element to inject an ink in the pressure chamber through the nozzle port; and the fluid inlet port being extending in a predetermined angle with respect to the longitudinal pressure chamber.

The fluid inlet port may be extending in a direction substantially perpendicular with respect to a longitudinal direction of the pressure chamber.

The fluid inlet port may be extending in a direction of an acute angle with respect to a longitudinal direction of the pressure chamber.

BRIEF DESCRIPTION OF THE DRAWINGS

FIGS. 3(*b*) to 3(*d*) are partial cross-sectional views of the piezoelectric pump of the first principle arrangement shown in FIG. 1.

FIGS. 4(*b*) and 4(*c*) are horizontal cross-sectional views.

FIGS. 5(*b*) and 5(*c*) are partial cross-sectional views of the metallic formation body used for a piezoelectric pump of the first principle arrangement shown in FIG. 1.

FIG. 9(*b*) is a view showing an electrode wiring of the embodiment according to the second principle arrangement of the present invention.

FIG. 11(*b*) is a perspective view showing an outline of the embodiment according to the second principle arrangement of the present invention.

DETAILED DESCRIPTION OF THE INVENTION

Referring to the accompanying drawings, an embodiment of the present invention will be explained in detail as follows.

Figure 1:
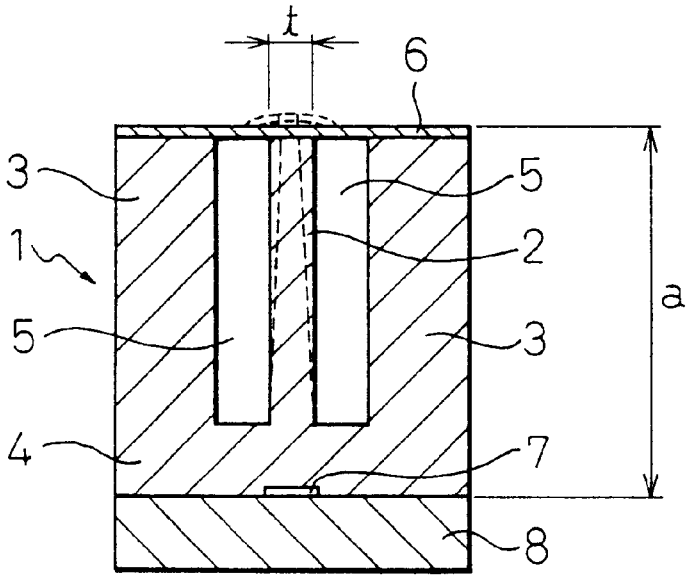
FIG. 1 is a cross-sectional view of an embodiment showing the first principle arrangement of the present invention.

FIG. 1 is a cross-sectional view of an embodiment showing the first principle arrangement of the present invention. The piezoelectric body block 1 includes: a piezoelectric body 2 which is vertically arranged at the center; walls 3 arranged on both sides of the piezoelectric body block 1; a bottom portion 4; and grooves 5 arranged between the piezoelectric body 2 and both walls 3. In the upper portion of the piezoelectric body block 1, there is provided a thin elastic metallic film 6 in such a manner that the thin elastic metallic film 6 is fixed to upper ends of both walls 3 of the piezoelectric body block 1 and that the thin elastic metallic film 6 comes into contact with an upper end of the piezoelectric body 2. There is provided an electrode 7 at the bottom 4 of the piezoelectric body block 1 on the lower side of the piezoelectric body 2. The overall block 1 is fixed onto a base plate 8.

The thin metallic film 6 also functions as one of the electrodes. It is possible to assume that both walls 3 and the bottom portion 4 of the piezoelectric body block 1 are rigid bodies. Accordingly, the piezoelectric body 2, which is arranged at the center, is composed in such a manner that the electrode 6 is attached at the upper portion and also the electrode 7 is attached at the lower portion, and the thickness of the piezoelectric body 2 is "t" and the height is "a", wherein the polarizing direction coincides with the vertical direction. Grooves 5 arranged on both sides of the piezoelectric body 2 are surrounded by the piezoelectric body 2, both walls 3, bottom portion 4 and thin metallic film 6 which functions as an electrode. Therefore, each groove 5 is formed into a closed space, which is a pressure chamber.

When voltage V is impressed between the electrodes 6 and 7, the piezoelectric body 2 is deformed in the vertical direction (the polarizing direction) by the distance of $Vd_{33}$. That is, the piezoelectric body 2 is expanded by the action of an electric field, so that the thin metallic film 6 is expanded upward. At the same time, the piezoelectric body 2 is contracted in the horizontal direction by the distance of $Vd_{31}a/t$. Due to the foregoing, the volume of the pressure chamber 5 is increased. When the voltage is removed, the volume of the pressure chamber 5 is reduced by the elasticity of both the thin metallic film 6 and the piezoelectric body 2. Accordingly, the pressure in the chamber is increased. The characteristic of the present invention is that the displacement in the same direction (the expanding direction or the contracting direction) is caused in the pressure chamber 5 when the deformation in the vertical direction and the deformation in the horizontal direction cooperate with each other as described above.

According to the arrangement of the conventional piezoelectric pump, since the pressure chamber is pushed from the outside, only one of the deformation in the vertical direction and the deformation in the horizontal direction can be utilized. In the present invention, as shown in FIG. 1, the thin piezoelectric body 2 is used which tends to buckle easily so that the frequency response is remarkably deteriorated. However, in the above restoring motion of the piezoelectric body 2, compressive stress given to the pressure chamber 5 is caused by the displacement of the piezoelectric body 2 in the contracting direction. Consequently, there is no possibility of buckling of the piezoelectric body 2.

The ink jet printer is a typical example to which the present invention is applied. As an image of high resolution is required for this type printer, the ink particle size is reduced, and higher accuracy of the ink particle size is required. In this case, it is required to reduce intervals of the nozzles (not shown in FIG. 1). Therefore, the conventional piezoelectric pump is designed in the following manner. In the conventional piezoelectric pump, in order to reduce the nozzle intervals and further to increase a distance of displacement of the piezoelectric body to a value corresponding to a quantity of injection, deformation in the direction of $d_{31}$ is utilized and the value of L/t is increased so that the displacement of a thin plate in the compressive direction can be used. That is, the conventional piezoelectric pump is formed into a thin plate structure. Accordingly, there is a possibility of occurrence of buckling of the piezoelectric body. Consequently, in general, the piezoelectric body pushes the pressure chamber from the outside in the conventional piezoelectric pump.

However, in the embodiment of the present invention shown in FIG. 1, since the piezoelectric body 2 is arranged in the pressure chamber 5, the shape of the piezoelectric body 2 is seldom restricted. In this embodiment, the thin metallic film 6 is used as a common electrode, and the lower electrode 7 is an individual electrode which is separate from the thin metallic film 6. Therefore, the individual electrode 7 is embedded between the solid bottom portion 4 of the block and the base plate 8, so that the electrodes can be easily insulated and the intervals of nozzles can be safely reduced.

It is necessary to make the pressure chamber 5 rigid so as to produce high pressure. In the embodiment shown in FIG. 1, a decrease in the height of the piezoelectric body 2 is the same as the strain of the piezoelectric body 2 itself in the longitudinal direction, and the strain ratio is approximately $1\times10^{-4}$ to $9\times10^{-4}$ at most. The modulus of elasticity of volume of liquid, for example, water, is $0.45\times10^{-9}$ $m^2/N$, so that the expected pressure is only several atm. On the other hand, when the pressure chamber 5 is charged with liquid, the rigidity of which is much higher than the rigidity of water, the same amount of contraction is received by a smaller quantity of liquid, so that the pressure in the pressure chamber 5 is increased. This is a fundamentally different point from the technique disclosed in the U.S. Pat. No. 4,752,788.

In many cases, in the piezoelectric pump, there are provided a large number of piezoelectric pump units, which are units for composing the piezoelectric pump shown in FIG. 1, wherein the piezoelectric pump units are arranged in parallel with each other. In this case, the rigidity of both wall portions 3, which are bulkheads provided between the two piezoelectric pump units adjacent to each other, must be increased so as to prevent the occurrence of pressure interference between the pressure chambers of two units adjacent to each other. Due to the foregoing, the piezoelectric pump is designed in such a manner that the thickness of the wall 3 and the bottom 4 of the piezoelectric body block 1 is sufficiently larger than the thickness of the piezoelectric body. Alternatively, the wall portions 3 may be made of a highly rigid material, the processability of which is high, such as metal. In this case, a portion of the piezoelectric body and the wall portion of metal are made to come into close contact with each other so that they can be joined. In this connection, it is difficult to make the piezoelectric body and the wall portion of metal to come into close contact with each other completely. However, the object is only to prevent the transmission of liquid pressure. Accordingly, when liquid is allowed to permeate into the joint portion slowly, it is sufficient to manufacture both joint faces in a highly accurate condition and press them to each other.

According to the well known structure disclosed in the U.S. Pat. No. 4,752,788, there is provided a piezoelectric body in a pressure chamber, and the injection pressure is obtained when a volume of the piezoelectric body is expanded. In this case, when the piezoelectric body is expanded in the direction of $d_{33}$, it is contracted in the direction of $d_{31}$, so that the expansion in the direction of $d_{33}$ and the contraction in the direction of $d_{31}$ are canceled to each other. Therefore, only a difference of displacement is effective for the volumetric expansion. However, according to the present invention, both the displacement in the direction of $d_{33}$ and the displacement in the direction of $d_{31}$ are additionally effective for a volumetric expansion or volumetric contraction of the pressure chamber. In this connection, as described later, in this embodiment, the thin metallic film 6, which can be easily made, forms inlet and outlet passages (not shown).

Figure 2:
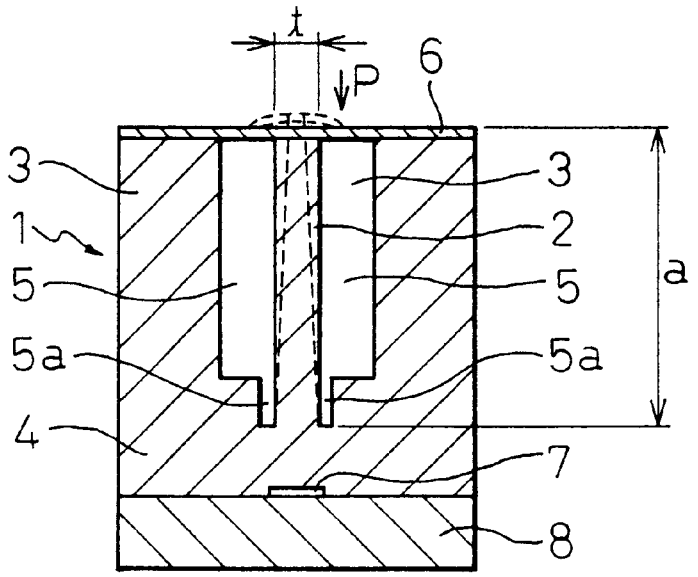
FIG. 2 is a cross-sectional view of a variation of the embodiment shown in FIG. 1.
Figure 3A:
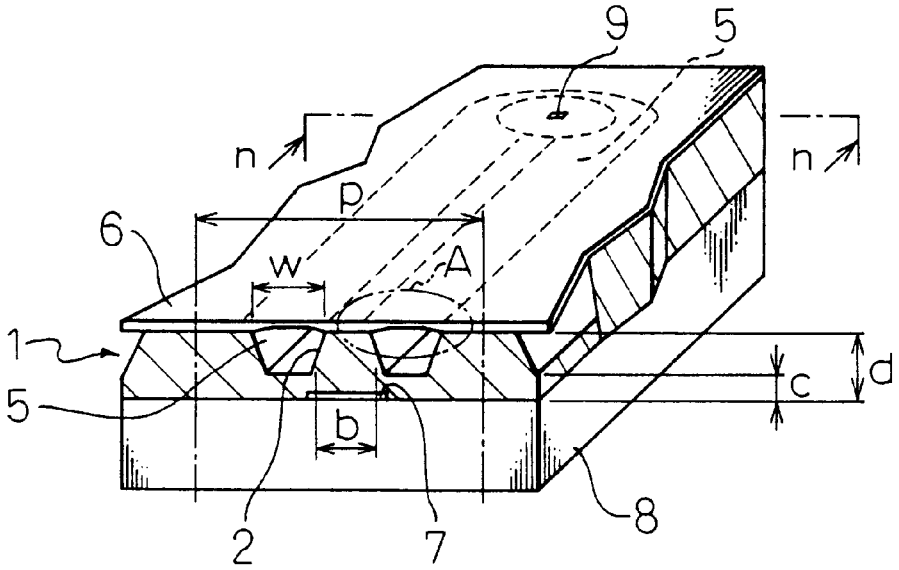
FIG. 3(*a*) is a specific perspective view of a piezoelectric pump of the first principle arrangement shown in FIG. 1.
Figure 3B:
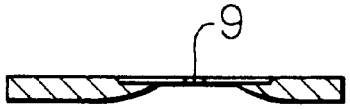
Figure 3C:
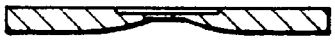
Figure 3D:
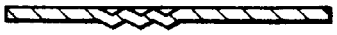

The embodiment shown in FIG. 2 is arranged in such a manner that the thin metallic film 6, which functions as an upper electrode, is pressed against the piezoelectric body 2 so that the drive section of the piezoelectric body 2 can be previously compressed. In this embodiment, pressure P is previously given to the piezoelectric body 2. Therefore, only the compressive stress is increased and decreased in the piezoelectric body 2, and the tensile stress is not given to the piezoelectric body 2. Accordingly, there is no possibility that the piezoelectric body 2 is damaged by tensility which is a weak point of the piezoelectric body 2.

According to the embodiment shown in FIG. 2, while the length "a" of the piezoelectric body 2 in the vertical direction is maintained, the volume of the pressure chamber 5 is made to be smaller than the volume of the pressure chamber of the embodiment shown in FIG. 1. For this reason, there are provided small grooves 5*a* on both sides of the lower portion of the piezoelectric body 2. Therefore, with respect to the contraction of the piezoelectric body 2, the thickness "t" and the height "a" of which are the same as those of the embodiment shown in FIG. 1, the volume of liquid in the pressure chamber 5 is reduced, so that the contraction ratio is increased. Accordingly, pressure in the pressure chamber 5 can be made higher. Other arrangements are the same as those of the embodiment shown in FIG. 1.

FIG. 3(*a*) is a perspective view of the embodiment of the piezoelectric pump, the cross-sectional view of which is shown in FIG. 1. As shown by a broken line, the pressure chamber 5 is formed into a substantial U-shape, and the thin metallic film 6 is attached onto the pressure chamber 5. There is provided an injection nozzle 9 on the thin metallic film 6 at the center of the U-shaped pressure chamber 5. In FIG. 3(*b*) which is a cross-sectional view taken on line n—n in FIG. 3(*a*), there is provided a thin metallic film 6 which is formed by means of electro-deposition. Plating is not conducted on a portion which has been previously covered with a resist pattern, and a plating layer extends onto an upper face of the resist pattern when it exceeds the resist thickness. As a result, the shape of the plating layer is formed as shown in FIG. 3(*b*). The injection nozzle 9 is formed by means of electro-deposition as described above. Except for that, it is also possible to form a tapered hole by means of plastic working.

In order to form a soft film in an intermediate portion between a portion where the thin metallic film 6 is fixed to the upper end of the wall 3 and a portion where the thin metallic film 6 is fixed to the upper end of the piezoelectric body 2, as shown in the cross-sectional view A of FIG. 3(*c*), the electro-deposition portion extends in the transverse direction so that the intermediate portion can be closed. Alternatively, the electro-deposition layer is formed into bellows as shown in FIG. 3(*d*). Alternatively, the intermediate portion may be formed into the same shapes by means of plastic working. Due to the foregoing, the thin metallic film 6 can be expanded and contracted in the upward and downward direction of the piezoelectric body 2.

It is possible to previously form a groove 5 in the piezoelectric body block 1 before baking as shown in FIG. 3(*a*). However, when the following manufacturing method is adopted, the groove 5 can be formed more accurately. By the manufacturing method, the piezoelectric body block 1 is baked under the condition that the overall surface of the piezoelectric body block 1 is maintained to be a plane, and the groove 5 is made by means of machining. In this case, it is necessary to close opening portions formed at both ends of the groove 5. The thin metallic film 6 may be bent so as to close the end portions of the groove, or alternatively other members may be used for closing the opening portions.

Figure 4A:
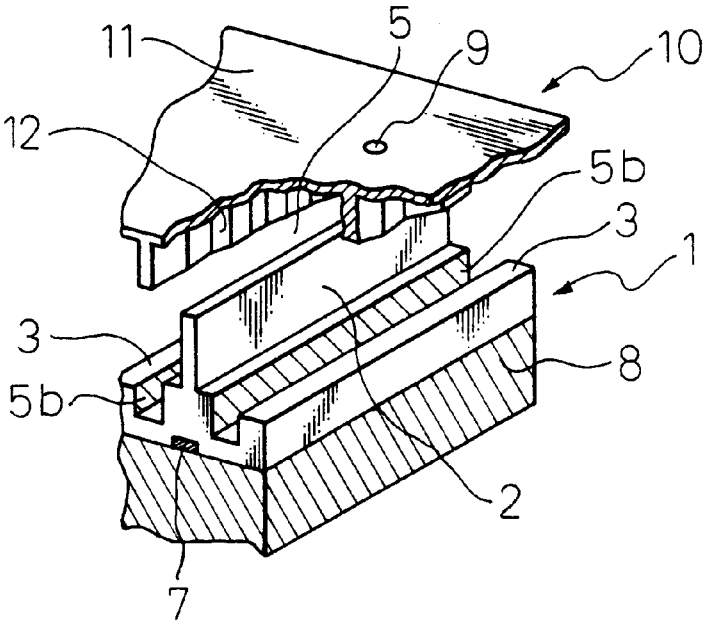
FIG. 4(*a*) is an exploded perspective view of a variation of the embodiment shown in FIG. 1.
Figure 4B:
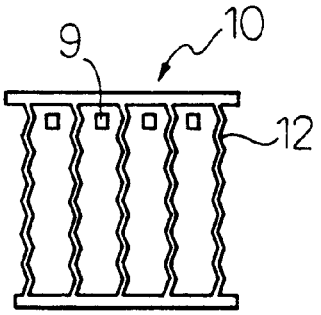
Figure 4C:
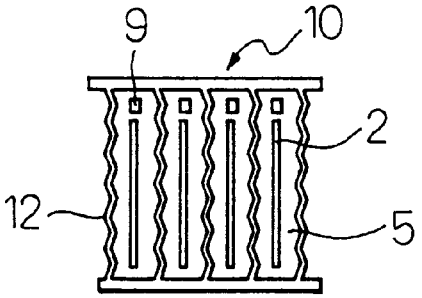

FIG. 4(*a*) is a perspective view showing another embodiment. There is provided a piezoelectric body 2 at the center of the piezoelectric body block 1. On both sides of the piezoelectric body block 1, there are provided low walls or short legs 3. There are provided grooves 5*b*, which function as pressure chambers, between the piezoelectric body 2 and the legs 3. There is provided an electrode 7 in the lower portion of the piezoelectric body 2. The piezoelectric body 2 is attached onto a base plate 8. The metallic forming body 10, which also functions as an upper electrode, includes an upper face portion 11 having nozzles 9, and a corrugated wall 12, wherein the upper face portion 11 and the corrugated wall 12 are integrated into one body. A lower end face of the corrugated wall 12 is joined onto an upper end face of the leg 3 of the piezoelectric body block 1 by adhesive. In this way, there are formed a groove 5*b* of the piezoelectric body block 1, corrugated wall 12, upper face 11 of the metallic forming body 10, and pressure chamber 5 of the piezoelectric body 2. This pressure chamber is communicated with the nozzles 9. When the pressure of fluid is increased by the action of displacement of the piezoelectric body 2, fluid of high pressure is injected by the nozzles 9. FIG. 4(*b*) is a horizontal cross-sectional view of the metallic forming body 10, and FIG. 4(*c*) is a horizontal cross-sectional view showing a relation between the piezoelectric body 2 and the corrugated wall 12. As shown in FIG. 4(*b*), the piezoelectric body 2 is arranged in the middle of the pressure chamber 5 surrounded by the adjoining corrugated bulkheads 12.

In this embodiment, the rigidity of the bulkhead 12 provided between the adjoining units can be enhanced when the bulkhead 12 is made of a thin corrugated film. When the forming body 10 having the corrugated wall 12 described in this embodiment is made of metal, it is possible to form the bulkhead 12 by means of plastic working or electro-deposition (plating), so that an aspect ratio of the bulkhead can be increased.

Figure 5A:
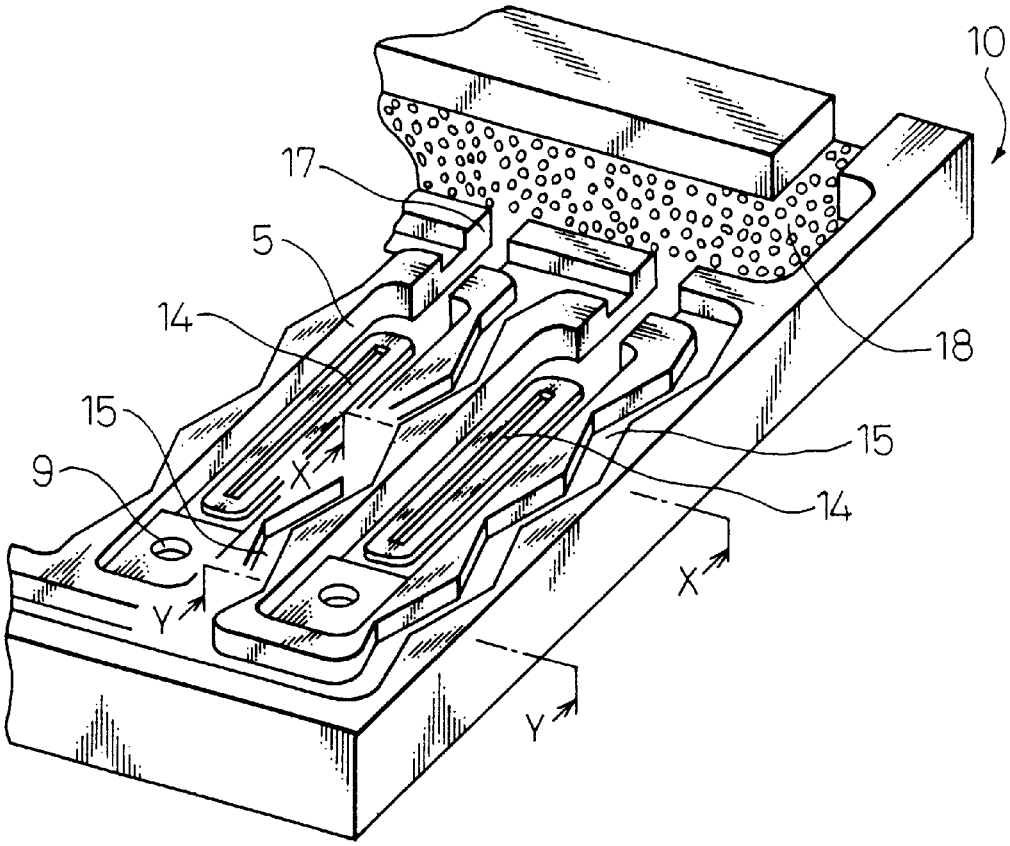
FIG. 5(*a*) is a perspective view of a metallic formation body used for a piezoelectric pump of the first principle arrangement shown in FIG. 1.
Figure 5B:
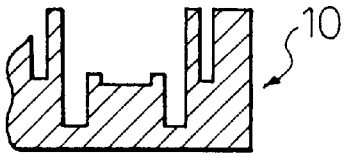
Figure 5C:
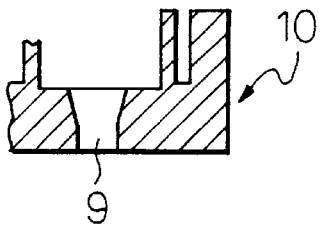
Figure 6:
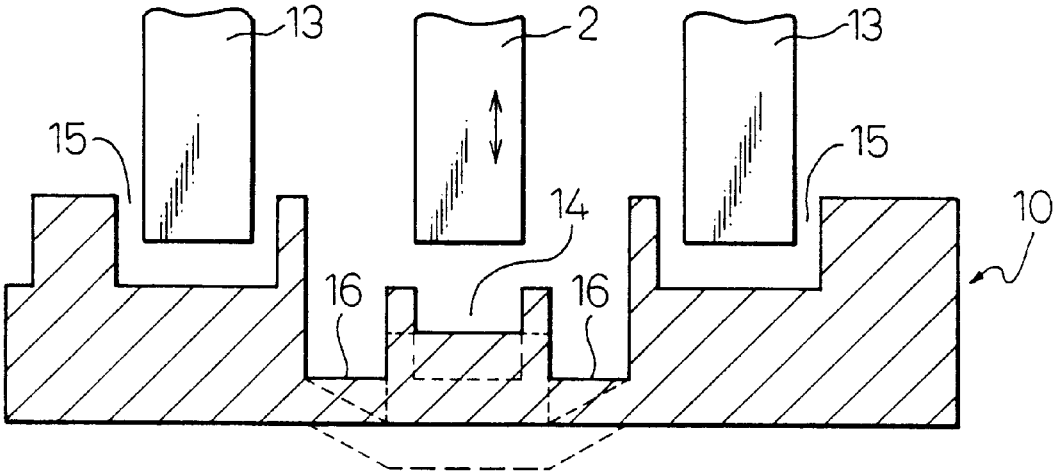
FIG. 6 is a cross-sectional view of the metallic formation body.

FIG. 5(*a*) is a perspective view of the metallic forming body 10 shown in FIG. 4(*a*), wherein the view is taken from the side of the piezoelectric body 2. FIG. 5(*b*) is a cross-sectional view of the metallic forming body 10 taken on line X, and FIG. 5(*c*) is a cross-sectional view of the metallic forming body 10 taken on line Y. FIG. 6 is a cross-sectional view taken on line X in FIG. 5(*a*), which shows a relation of the metallic forming body 10, the piezoelectric body 2 and the corrugated bulkhead 13. In the embodiment shown in these drawings, the corrugated bulkhead 13 is arranged on the side of the piezoelectric body block. That is, portions which correspond to both walls 3 shown in FIG. 1 are formed into corrugated shapes. The metallic forming body 10 is formed as a deformed body by means of plastic working or plating. At the center, there is provided a rectangular groove 14 to be engaged with the piezoelectric body 2. On both sides of the groove 14, there are provided corrugated grooves 15 to be engaged with the corrugated bulkheads 13. In the peripheral portions 16 of these grooves 14, 15, the wall thickness is reduced, so that the thin peripheral portions 16 can be elastically deformed as a soft body as shown by a broken line in the drawing when the piezoelectric body 2 is displaced in the direction of an arrow in FIG. 6.

Each pressure chamber 5 is communicated with a common ink chamber 18 via an ink introducing port 17. In order to absorb a sharp fluctuation of pressure in a plurality of pressure chambers 5, wall thickness of the bottom of this ink chamber 18 is reduced so as to enhance the elasticity. This ink chamber is operated as follows. When a voltage is impressed between the electrodes, the piezoelectric body 2 is displaced. Due to the displacement of the piezoelectric body 2, the pressure chamber 5 is expanded. At this time, ink is supplied to the pressure chamber 5 of each unit from the common ink chamber 18 via the ink introducing port 17. When a voltage is removed, the piezoelectric body 2 is displaced in the opposite direction, so that the pressure chamber 5 is contracted. At this time, ink in the ink chamber 18 is injected from the nozzle.

Figure 7A:
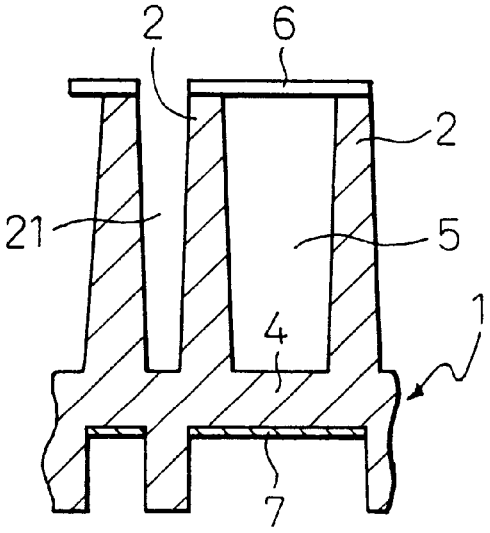
FIGS. 7(*a*) and 7(*b*) are cross-sectional views of an embodiment according to the second principle arrangement of present invention.
Figure 7B:
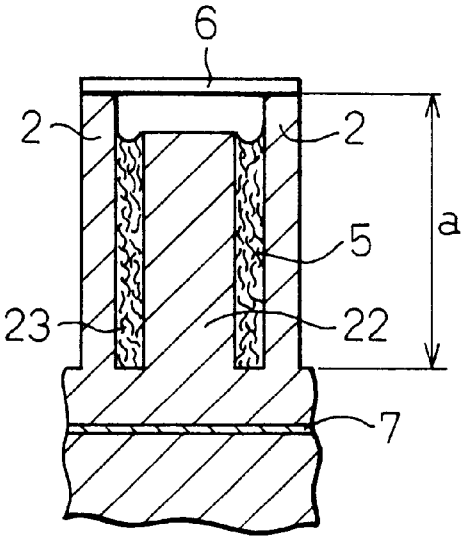

FIGS. 7(*a*), 7(*b*) and 8 are views showing the second principle arrangement of the piezoelectric pump of the present invention. One end of the piezoelectric body 2 in the direction of $d_{31}$ or $d_{33}$ is fixed. A pair of piezoelectric bodies 2 are arranged for one unit of the piezoelectric body 2, and the free ends of the piezoelectric bodies 2 are connected, and this connecting portion forms a closed space of the pressure chamber 5.

In the embodiment shown in FIG. 7(*a*), in the bottom 4 which is a fixing portion of the piezoelectric body block 1, a pair of piezoelectric bodies 2 are vertically arranged with respect to one unit. Upper ends of the piezoelectric bodies 2 are covered with a metallic plate 6 which also functions as an upper electrode. In this way, the pressure chamber 5, which is a closed space, can be formed. There is provided a clearance 21 for absorbing a displacement between the piezoelectric bodies 2 adjacent to each other. There is provided no base plate on the lower side of the bottom 4 of the piezoelectric body block 1, but there is provided a lower electrode 7 in the groove of the bottom 4. In this embodiment, the shape of the piezoelectric body 2 is tapered. Due to the tapered shape, restrictions placed by a tool (not shown) in the process of machining can be reduced, so that various delicate shapes can be formed by machining.

The piezoelectric pump of the embodiment shown in FIG. 7(*a*) is manufactured as follows. First, the piezoelectric body block is machined so that a groove (groove of the first group) to be made into the pressure chamber 5 can be formed. Under the above condition, the upper and the lower electrode 6, 7 are formed. Specifically, the lower electrode 7 is formed in the groove provided on the lower side of the bottom 4, and the metallic plate 6 is made to adhere to the upper ends of a pair of piezoelectric bodies 2. Next, the groove 21 (the groove of the second group) is formed between the units.

When a voltage is impressed between the upper and the lower electrode 6, 7, the piezoelectric body 2 is elongated in the longitudinal direction, and at the same time the thickness of the piezoelectric body 2 is reduced in the wall thickness direction. When the voltage is removed, the piezoelectric body 2 is contracted in the longitudinal direction, and the thickness of the piezoelectric body 2 is returned to the initial value.

In the embodiment shown in FIG. 7(*b*), the piezoelectric body block 1 is machined in the following manner. When the grooves are formed in the piezoelectric body block 1 by means of machining, a pair of piezoelectric bodies 2 are formed in such a manner that they are vertically arranged in parallel with each other, and at the same time a rigid portion 22 is left between the piezoelectric bodies 2. Due to the foregoing, the pressure chamber 5 is formed between the pair of piezoelectric bodies.2 and the rigid portion 22. In this case, it can be assumed that liquid has been replaced with a highly rigid body. Therefore, it is possible to more increase the pressure in the pressure chamber 5. The reason why the pressure chamber 5 is filled with insulating material 23 is to prevent a short circuit caused when an electrically conductive liquid is used and comes into contact with the piezoelectric body 2.

Figure 8:
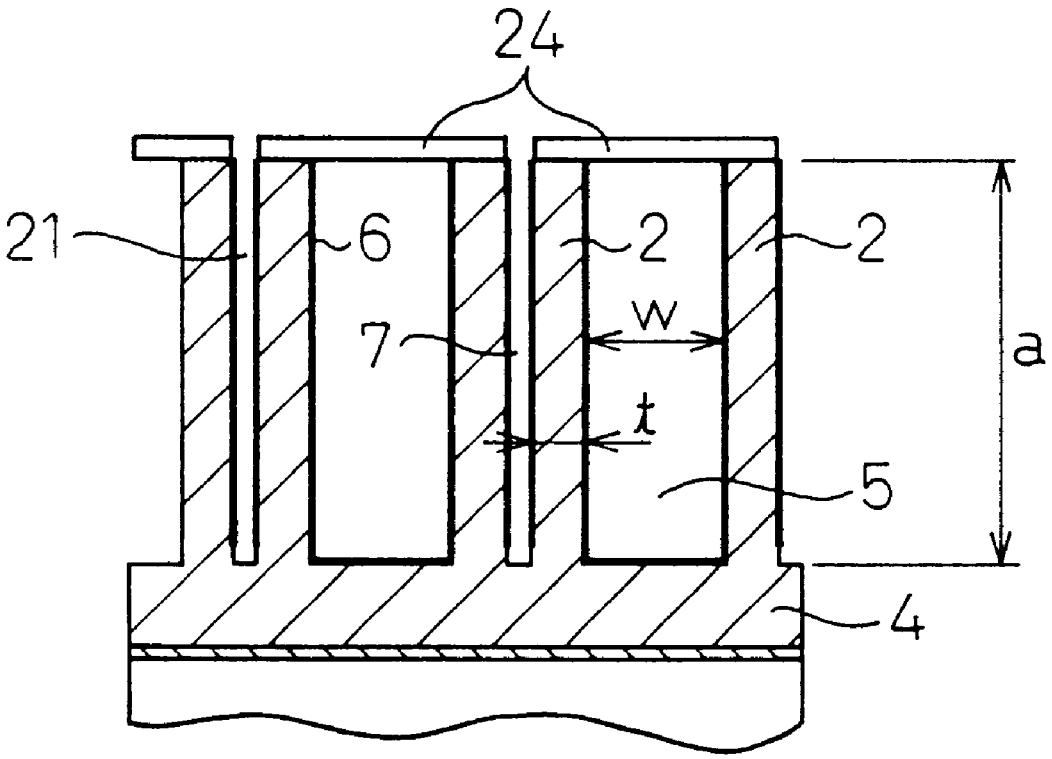
FIG. 8 is a cross-sectional view of another embodiment according to the second principle arrangement of the present invention.

The embodiment shown in FIG. 8 is arranged as follows. The piezoelectric body block 1 is subjected to comb-processing, and the piezoelectric body 2 (thickness: t, height: a), which are a pair of side walls provided for one unit, are vertically formed in parallel. The inside (including the bottom face) and the outside (including the side wall 2 of the adjacent unit) of the pair of piezoelectric bodies 2 are subjected to plating or vapor-deposition so as to form an electrode. Then the upper face of the piezoelectric body 2 is ground so as to remove a portion of the electrode, and the inside and the outside electrode 6, 7 are insulated from each other. A metallic plate 24 is joined to the upper portions of the pair of the piezoelectric bodies 2, so that the pressure chamber 5, the width of which is "w", can be formed, which is a closed space. Concerning the piezoelectric body 2, the thickness direction coincides with the polarizing direction. Therefore, when a voltage is impressed between the electrodes 6 and 7, the thickness "t" is expanded and the height "a" is reduced. As a result, the volume of the pressure chamber 5 is reduced. When the electrodes of reverse polarity are used, the volume of the pressure chamber 5 is expanded.

It is possible that the material of the electrodes 6 is different from that of the electrodes 7. It is also possible that the thickness of the electrodes 6 is different from that of the electrodes 7.

The piezoelectric pump of the embodiment shown in FIG. 8 can be manufactured in the following manner. In the first process, the grooves to be used as the pressure chamber 5 are formed into a comb-shape. The electrode 6 is formed inside the pressure chamber 5 by means of plating and others. A plating layer in the upper portion is removed, or alternatively the upper portion is covered with a resist layer so that a plating layer can not be formed in the upper portion. In the second process, the upper plate 24 is joined to the upper portion by adhesive having insulating property. In the third process, a narrow groove 21 between the adjacent units is formed. Then the electrode 7 is formed in the groove 21 by means of plating and others. After that, the other electrode of the piezoelectric body 2, that is, the electrode 6 is joined to each other with respect to a plurality of units, so that a common electrode (not shown) can be formed.

On the other hand, the width of the groove 21 between the adjacent units is made to be narrow, so that the bottom portion of the groove 21 can not be subjected to plating and the electrode 7 of the adjacent unit is naturally insulated. Therefore, the electrode 7 of the adjacent unit can be independently driven. Alternatively, when the bottom of the groove 21 is covered with a resist layer, the electrode can be insulated in the same manner. As described above, the electrode 7 can be made into an individual electrode to be independently driven for each unit.

In any embodiment shown in FIGS. 7(*a*), 7(*b*) and 8, the free end of the piezoelectric body 2 can be moved in the longitudinal direction. Together with the contraction (or expansion) in the longitudinal direction, the wall of the piezoelectric body 2 is expanded (contracted) in the thickness direction. That is, with respect to a change in the volume of the pressure chamber 5, deformation is made in the same direction so that the pressure chamber 5 can be contracted or expanded. In this way, pressure of fluid in the pressure chamber 5 is controlled.

In the embodiment shown in FIG. 8, when the electrode 6 on the pressure chamber S side is connected to an individual driving circuit and the electrode 7 between the adjacent units is connected to a common electrode, since ink is electrically conductive, a short circuit is caused between the individual electrodes when a different driving voltage is impressed upon each individual electrode. Fort this reason, it is necessary to insulate an upper face of the electrode.

Figure 9A:
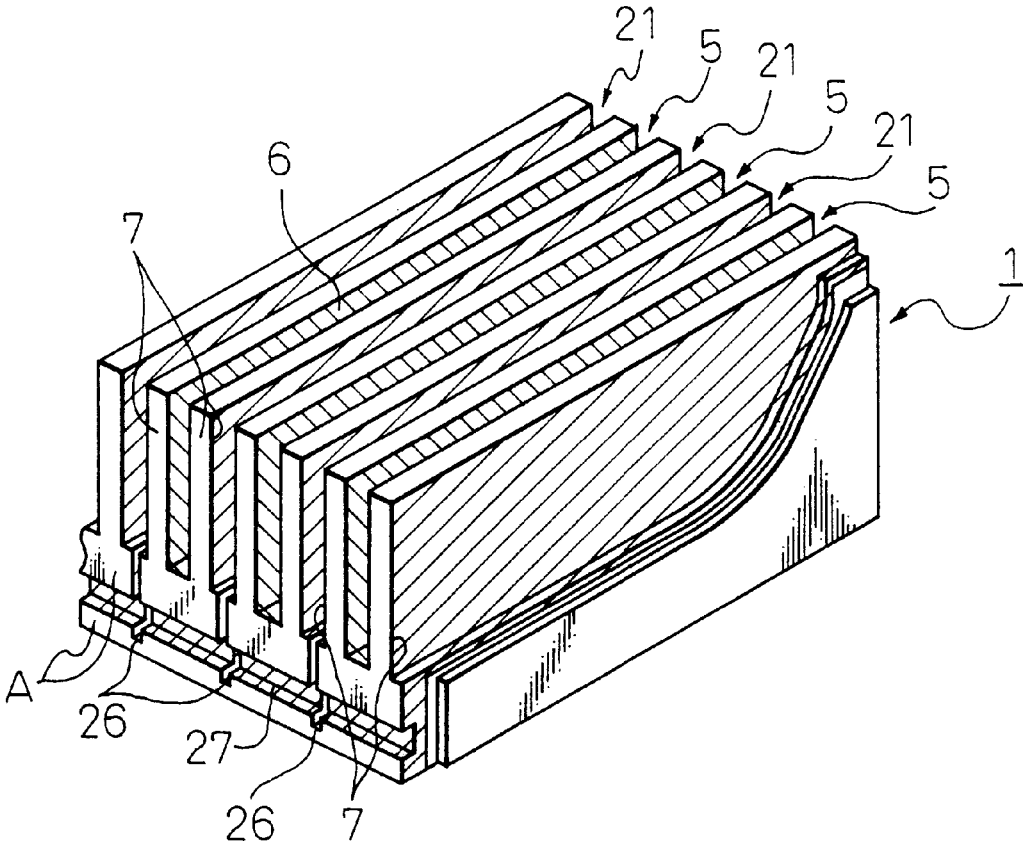
FIG. 9(*a*) is an exploded perspective view of an embodiment according to the second principle arrangement of the present invention.
Figure 9B:
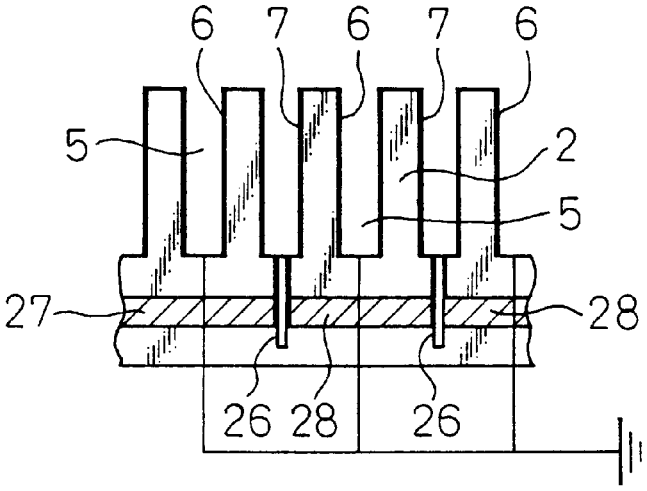

FIGS. 9(*a*) and 9(*b*) are views showing an arrangement in which the above problems can be avoided. In this embodiment, in the piezoelectric body block 1, there is provided a groove to be used as a pressure chamber 5, and also there is provided a groove 21 formed between the adjacent units. Further, in the groove 21 formed between the adjacent units, there is provided a narrow groove: 26 which is deeply formed in the longitudinal direction. On the front face of the piezoelectric body block 1, there is provided a groove 27 which crosses the grooves 26 and covers all units in the transverse direction. When plating is conducted under the above condition, a plating layer is not formed in the bottom portion of the narrow deep groove 26. Accordingly, the electrodes 7 between the adjacent units can be insulated from each other.

That is, when the surface of the piezoelectric body block (the surfaces A in the drawing) is polished so as to remove the plating layer, the electrodes 7 outside the pressure chambers 5 of the units are connected to each other by the plating portion 28 deposited in the groove 27 in the transverse direction. At the same time, the electrode is insulated from the outside electrode of the adjacent unit by the deep groove 26. Accordingly, as shown in FIG. 9(*b*), the electrodes 6 formed on the inner faces of the pressure chambers 5 are connected to each other as a common electrode, and the electrodes 7 on the outer faces of the pressure chambers 5 are connected to the drive circuit of the individual electrode by the conductive portion 28 of the groove 27 in the transverse direction. In this connection, the plating layer inside the pressure chamber 5, that is, the electrode 6 may be connected on the back side. Alternatively it may be connected using the electrical conductivity of ink.

Figure 10:
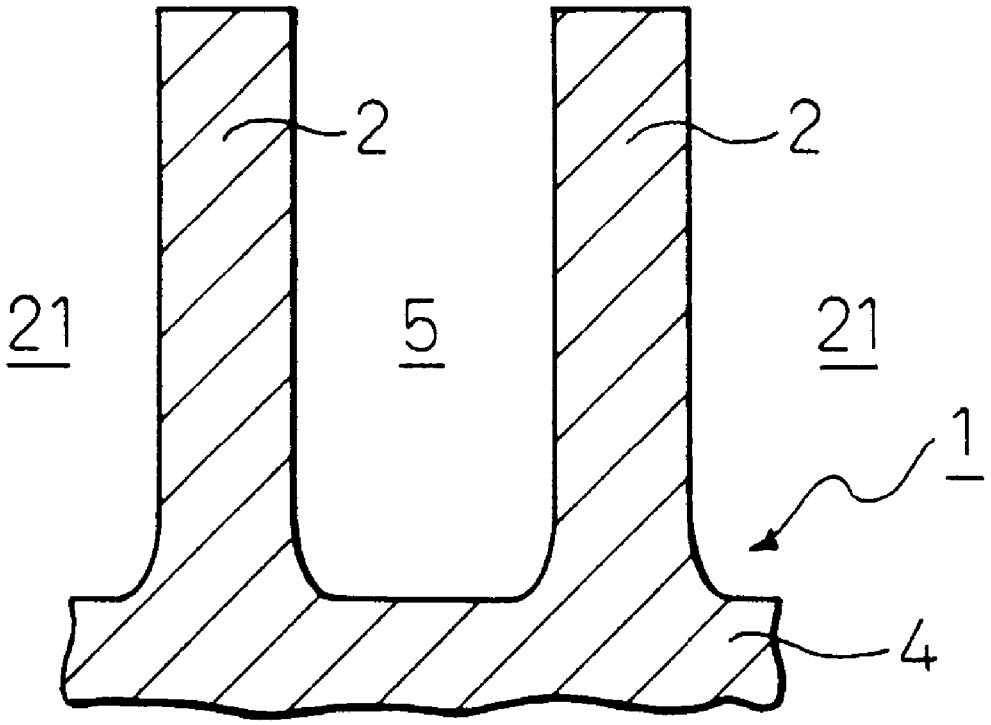
FIG. 10 is a view showing a sectional shape of a wall of the piezoelectric body.

FIG. 10 is a view showing an arrangement in which the grooves 5 to be used as pressure chambers and the grooves 21 provided between the adjacent units are formed into comb-shapes, wherein there is provided a radius of curvature at the root portion of the piezoelectric body 2, so that the stress concentration can be reduced when the piezoelectric body 2 is deformed.

Figure 11A:
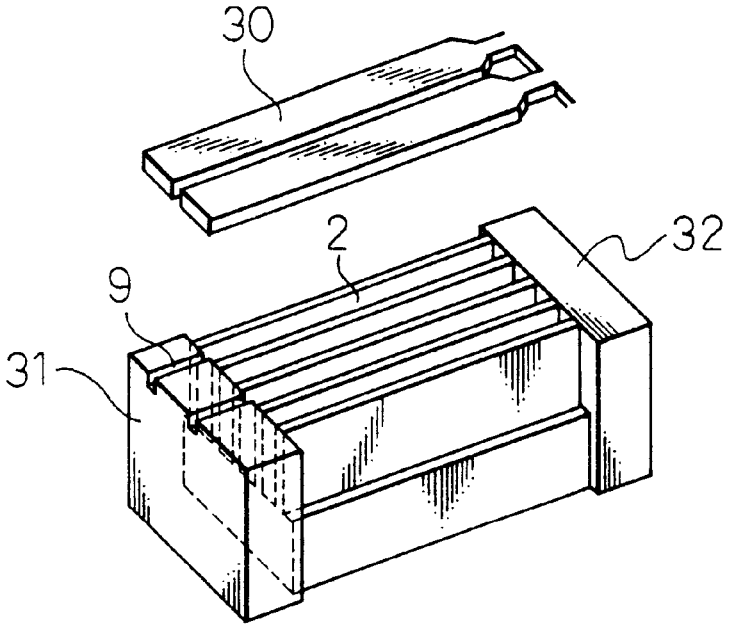
FIG. 11(*a*) is a perspective view showing an outline of the embodiment according to the second principle arrangement of the present invention.
Figure 11B:
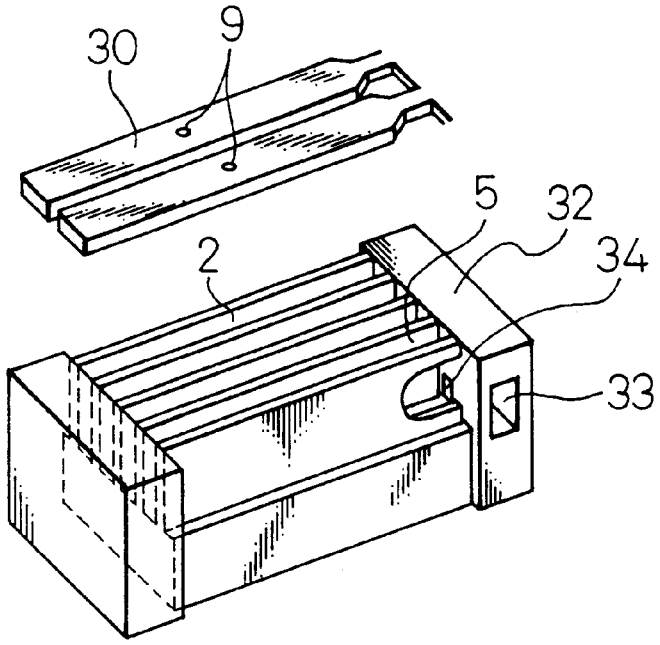

FIGS. 11(*a*) and 11(*b*) are views showing a condition of forming a space in the pressure chamber 5 as follows. The piezoelectric body block 1 shown in FIG. 9(*a*) is subjected to groove formation, and plating is conducted to form an electrode. The space is formed from a plate 30 attached to the upper portion, and also formed from the blocks 31, 32 attached to the front and rear portion, wherein the plate 30 and the blocks 31, 32 are joined to the piezoelectric body block 1. In FIG. 11(*a*), in the front block 31, there are provided narrow slits 9 corresponding to the pressure chambers 5, and these narrow slits 9 are used as nozzles from which fluid is injected forward. In FIG. 11(*b*), on the upper plate 30, there are formed small holes 9 corresponding to the pressure chambers 5, and these small holes 9 are used as nozzles from which fluid is injected upward. In the rear block 32, there is provided an ink supply path 33 which is common among the units, and ink is supplied to the pressure chamber 5 of each unit via an ink introducing port 34.

Figure 12:
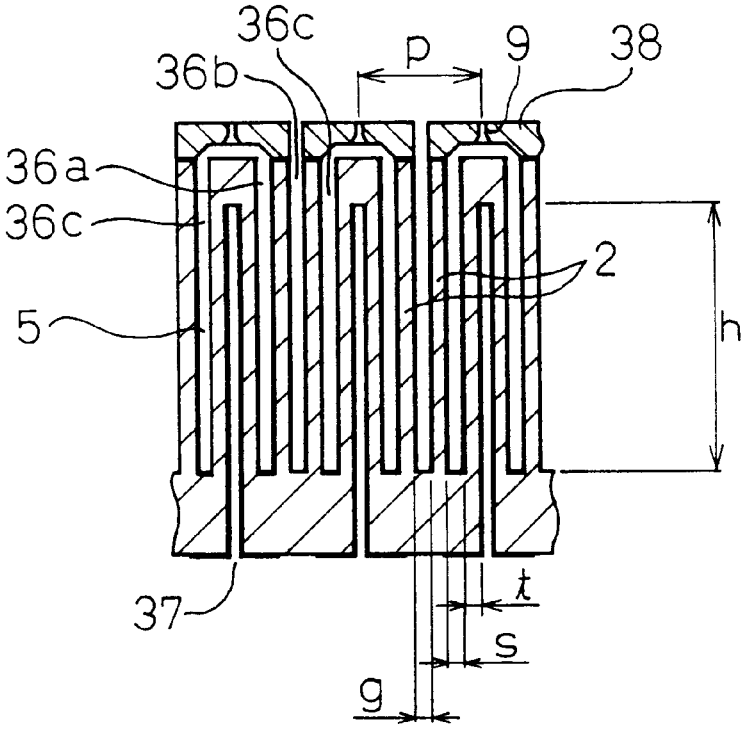
FIG. 12 is a cross-sectional view of still another embodiment according to the second principle arrangement of the present invention.

In the embodiment shown in FIG. 12, three comb-shaped grooves 36*a* to 36*c* are formed in the upper portion of the piezoelectric body block 1 in such a manner that the three comb-shaped grooves are continuously arranged in parallel with each other, and one comb-shaped groove 37 is formed in the lower portion alternately with the upper comb-shaped grooves. After that, an electrode is formed on the inner faces of the grooves 36*a* to 36*c* of the upper portion by means of plating. To the upper portion, a cover 38 is attached so that the two grooves 36*c*, 36*a* can be communicated with each other on the upper side. In this way, a reverse U-shaped pressure chamber 5 is formed from the grooves 36*c*, 36*a* and the cover 38. There are provided nozzles 9 on the cover 38.

In this case, one electrode is formed on the inner faces of the grooves 36*c*, 36*a*, and the other electrode is formed on the inside of the groove 36*b* provided between the adjacent units. A voltage is impressed between the above two electrodes. Then the expansion and contraction of the piezoelectric body 2 in the direction of $d_{33}$, that is, the expansion and contraction of the piezoelectric body 2 in the horizontal direction in the drawing directly comes into contact with fluid so that pressure can be transmitted. At the same time, the expansion and contraction of the piezoelectric body 2 in the direction of $d_{31}$, that is, the expansion and contraction of the piezoelectric body 2 in the vertical direction in the drawing makes the cover 38 rise and fall. In this way, the volume of the pressure chamber 5 can be expanded and contracted. This is an embodiment to accomplish the second principle arrangement of the present invention.

Figure 13:
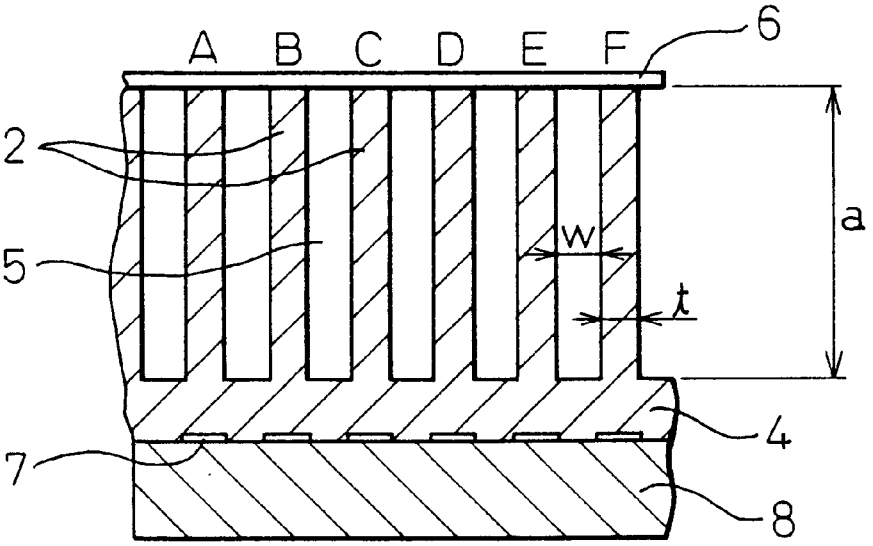
FIG. 13 is a cross-sectional view of an embodiment of the present invention in which a bulkhead of the piezoelectric body composing a pressure chamber is the same as a bulkhead of the adjoining unit.

FIG. 13 is a view showing an embodiment in which the intervals of the adjacent units can be more reduced. In this embodiment, the pressure chambers 5 are arranged alternately with the walls (piezoelectric bodies) 2. For example, the pressure chamber 5 formed between the piezoelectric bodies B and C is operated as follows. A voltage is impressed upon the walls of the piezoelectric bodies B and C so that the walls are expanded. Then the electrodes of the piezoelectric bodies B and C are short-circuited, so that the walls are contracted. In this way, fluid in the pressure chamber 5 can be injected. In this arrangement, it is impossible to simultaneously drive the pressure chambers of the adjoining units, however, it is possible to alternately drive the pressure chambers of the adjoining units. The piezoelectric bodies 2 are physically arranged at short intervals. Therefore, it is possible to conduct printing of high resolution.

In this case, the expansion and contraction of the adjoining pressure chambers affects the pressure chambers 5 concerned. Therefore, it exerts an important effect, so that fluid may be injected by the adjoining pressure chambers in an incomplete injecting condition. In this case, walls of the piezoelectric bodies A, D on both sides can be driven in such a manner that the walls are reversely expanded or contracted, so that the influence of the adjoining pressure chambers can be canceled. In this embodiment, the electrode 6 is arranged in the upper portion and the electrode 7 is arranged in the lower portion. Further, the direction $d_{33}$ of the piezoelectric body 2 is vertical, and the direction $d_{31}$ is horizontal.

Figure 14:
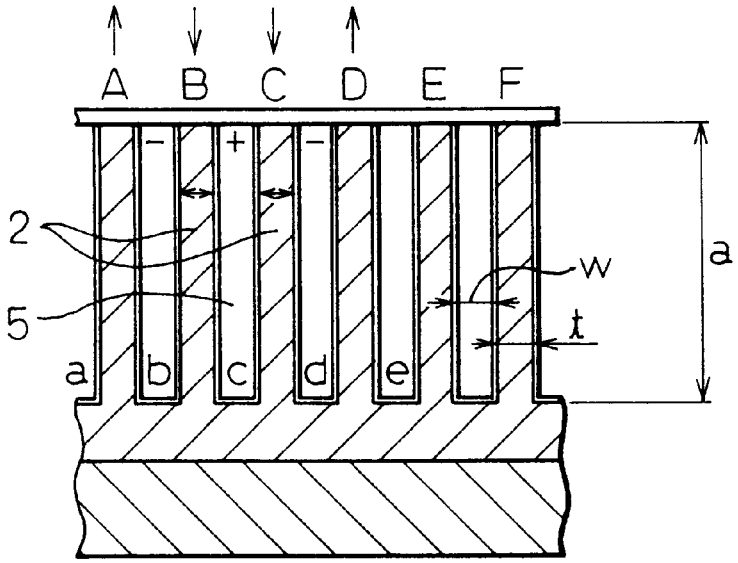
FIG. 14 is a cross-sectional view of another embodiment of the piezoelectric pump in which no clearance is formed between the units in the same manner as that of the piezoelectric pump shown in FIG. 13.

In the embodiment shown in FIG. 14, in order to arrange the piezoelectric bodies 2 so that the polarizing directions can be alternately reversed, poles of the electrodes formed on the walls of the grooves, which prescribe the pressure chambers 5, are alternately changed. For example, when the pressure chamber "c" is driven, a voltage is impressed upon the electrodes while the electrode of the pressure chamber "c" is determined to be a positive pole and the electrodes of the pressure chambers "b" and "d" are determined to be negative poles. Other electrodes are grounded. The thickness of the walls B and C, which are piezoelectric bodies 2, is increased, and the length of the walls B and C is reduced since the electrode of the pressure chamber "c" provided between the two walls is of positive polarity. The length of the walls A and D is extended in the longitudinal direction since the electrodes of the pressure chambers "b" and "d", which are respectively adjacent to the walls A and D, are of reverse polarity. In this way, pressure acts on the pressure chamber "c", so that the pressure chamber "c" can be driven.

In this connection, there is a possibility that the polarization disappears when an electric field of high intensity is impressed upon the reverse polarity. Accordingly, a voltage to be impressed upon one pole is restricted low. Therefore, the amounts of expansion of the walls A and D are smaller than the amounts of contraction of the walls B and C. Consequently, the effect caused by a change in the pressure can be substantially canceled by an amount of ½ although it can not be completely canceled. In order to avoid the occurrence of driving conducted in the manner of reverse polarity described above, units disposed at 5 intervals are driven simultaneously. For example, in order to contract the pressure chamber "c" as shown in the drawing, the walls B and C are driven in the manner of positive polarity, however, the walls A and D are driven in the manner of positive polarity before driving the walls B and C, so that the pressure chambers "b" and "d" can be contracted. Next, simultaneously when the walls B and C are driven, the walls A and D are short-circuited so as to discharge the electric charge. Then the pressure chambers "b" and "d" are expanded and the pressure chamber "c" is contracted. Accordingly, even if the walls A and D are expanded toward the pressure chambers "b" and "c", the expansion can be canceled. When simultaneous driving is conducted at 5 intervals as described above, it is sufficient to arrange 4 invalid units on both sides for scanning the line nozzles.

In this embodiment, it is possible to prevent the injection of fluid from the adjoining pressure chamber, which is not operated, in the following manner. The pressure chambers 5 are alternately operated at all times. Accordingly, while a common fluid supply port (not shown) is used for each group, pressure is increased and decreased synchronously with the driving period. Therefore, the pressure in the pressure chamber on the driving side is maintained high, and the pressure in the pressure chamber on the non-driving side is maintained low. In this way, the injection of fluid from the adjoining pressure chamber, which is not operated, can be prevented.

Figure 15A:
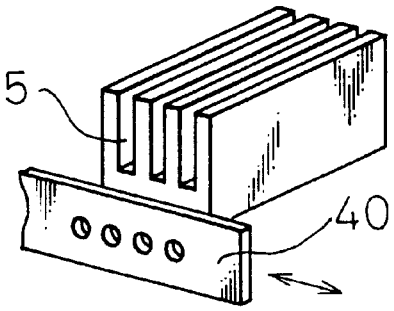
FIGS. 15(*a*) and 15(*b*) are views showing a relation between a piezoelectric body block and a nozzle plate.
Figure 15B:
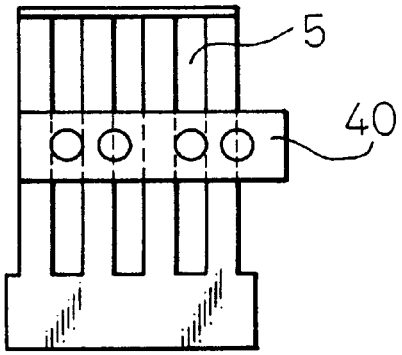

As shown in FIGS. 15(*a*) and 15(*b*), it is possible to provide the same effect in the following manner. There is provided a shutter 40 synchronizing with the driving period at a fluid supply portion communicated with each pressure chamber 5. The shutter is opened when fluid is sucked into the pressure chamber 5, and the shutter is closed when fluid is injected from the nozzle (not shown). When the shutter is operated in this way, the same effect can be provided.

Figure 16:
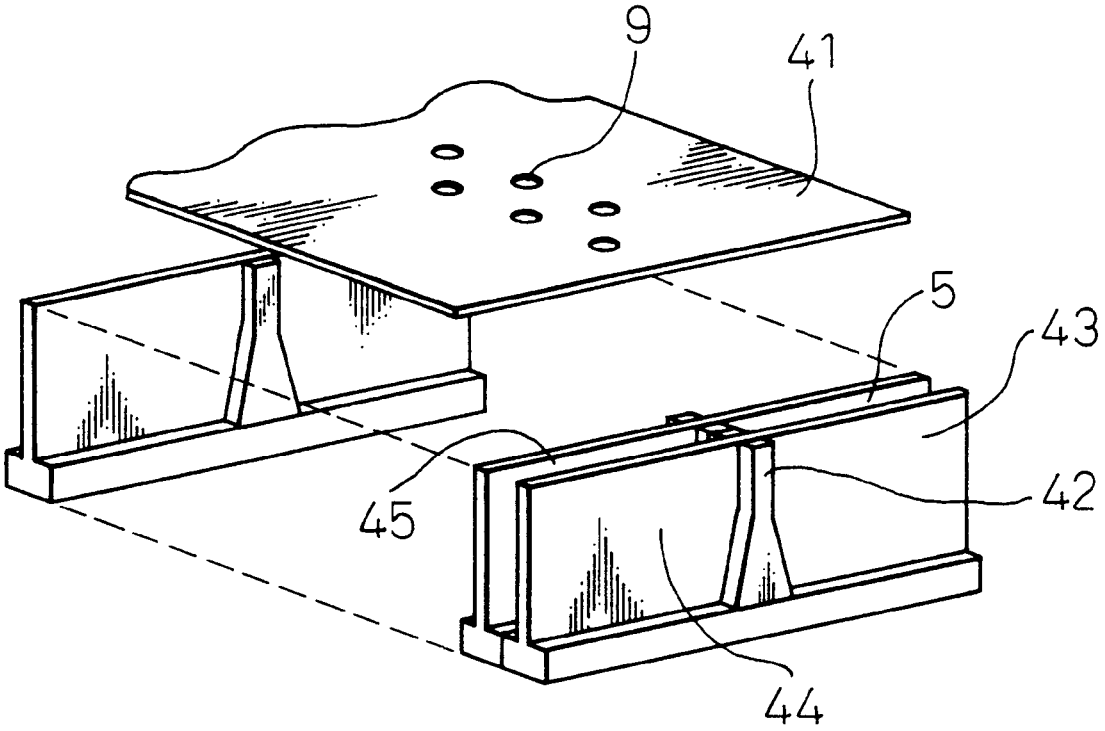
FIG. 16 is an exploded perspective view showing an embodiment in which the pressure chambers are alternately formed.

The embodiment shown in FIG. 16 is arranged as follows. In order to avoid interference made with respect to the adjoining units, the pressure chambers 5 are alternately arranged in the groove direction as shown in the drawing, and a bulkhead 42 is provided at the center of the groove so that the front and the rear portion can be separated, and also nozzles 9 provided on the upper plate 41 are alternately arranged in a portion close to the center and respectively communicated with the pressure chambers 5. In the above arrangement, the space 45 formed adjacent to the pressure chamber 5 is an invalid space, however, it functions as a separation space for avoiding the occurrence of interference. This invalid space 45 is charged with air or soft material (not shown). Since machining for forming the groove is a very small portion of the manufacturing process, the overall manufacturing cost is seldom raised when the space 45 is made by machining. It is possible to reduce the manufacturing cost as compared with a case in which they are separately machined and joined. In this connection, concerning the wall of the piezoelectric body, the wall of the pressure chamber 5 functions as a piezoelectric body 43, and the invalid space 45 functions as a bulkhead 44.

Figure 17:
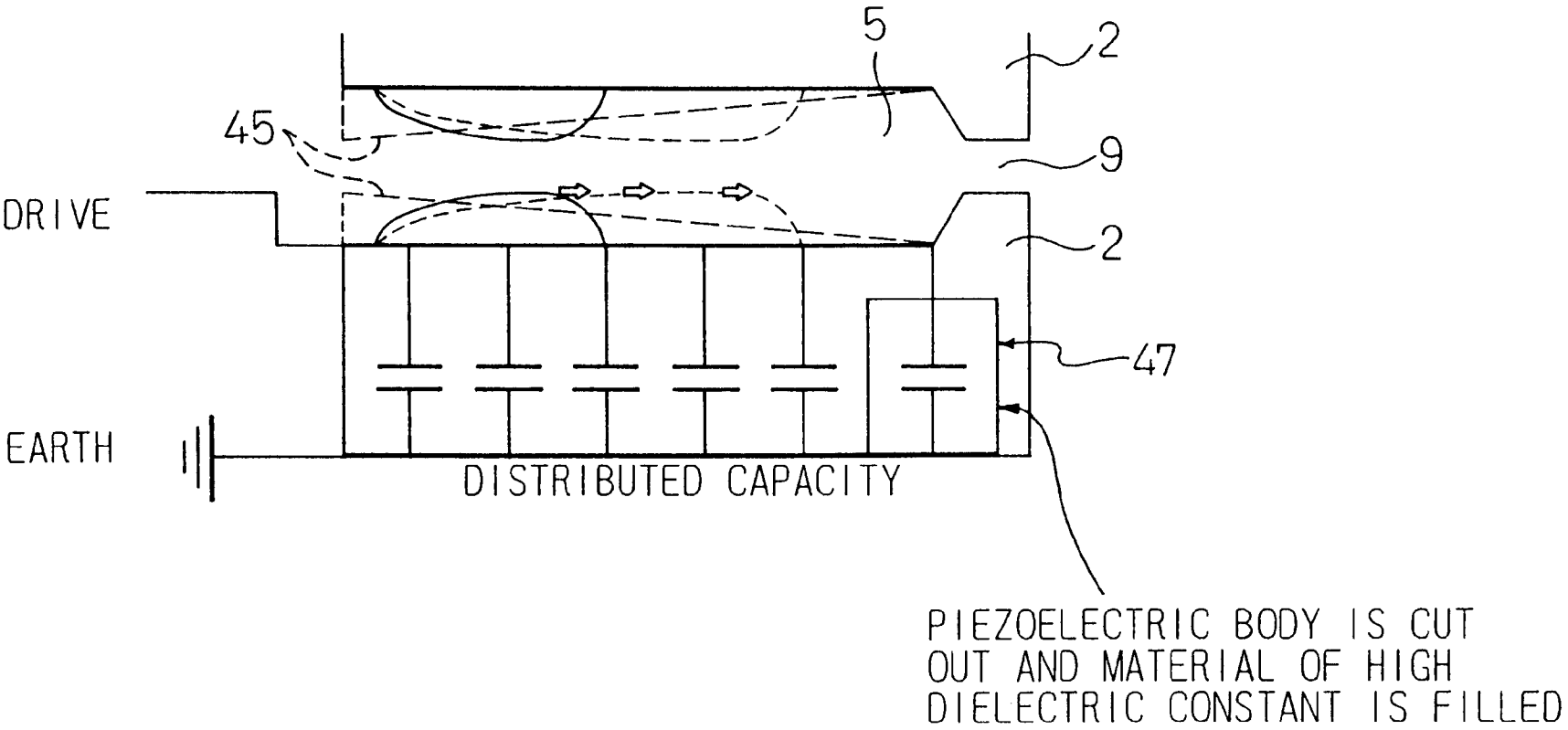
FIG. 17 is a schematic illustration showing an example of the action of the pressure chamber conducted by the piezoelectric body.
Figure 18:
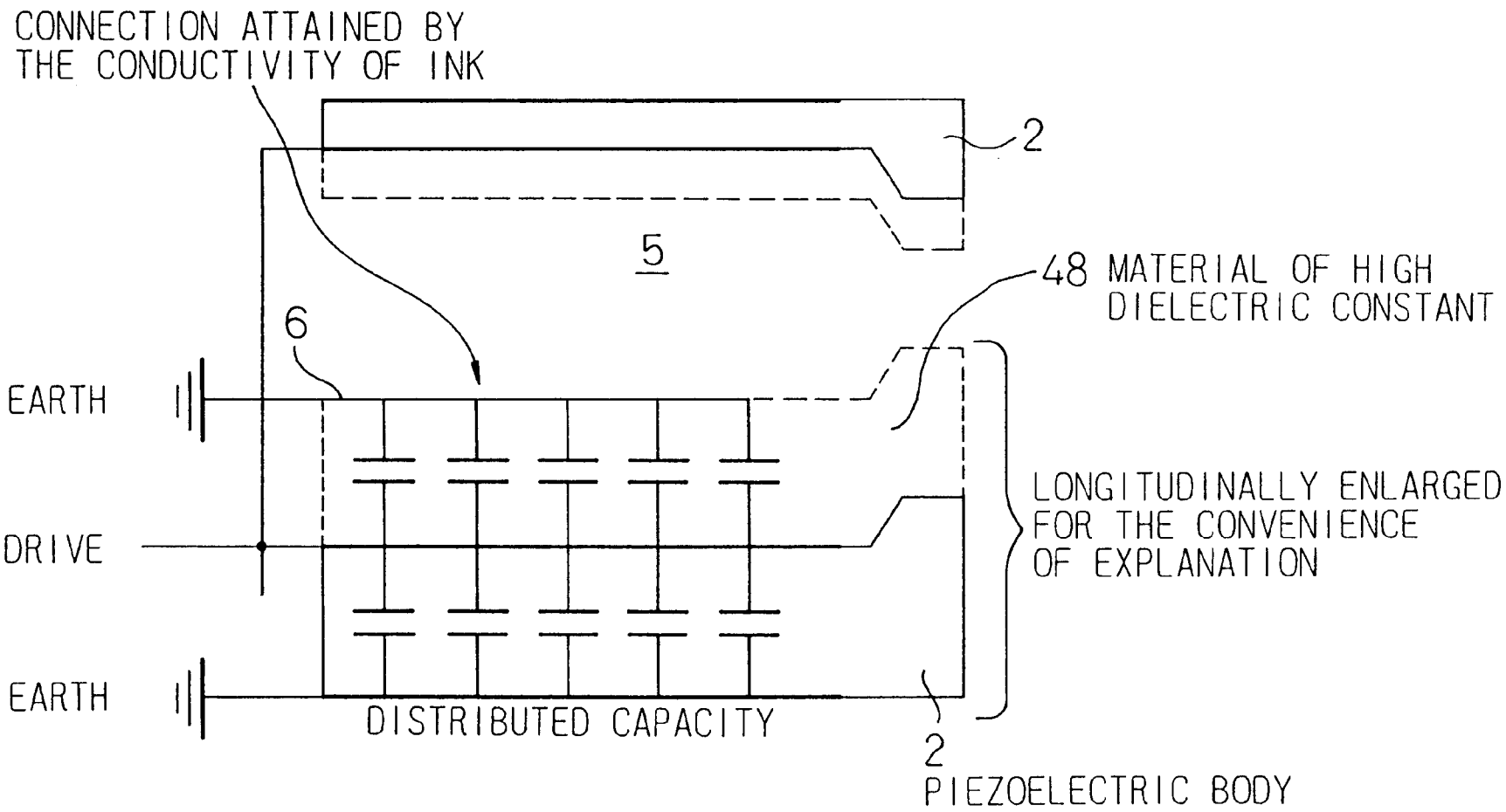
FIG. 18 is a schematic illustration showing another example of the action of the pressure chamber conducted by the piezoelectric body.

FIGS. 17 and 18 are views showing the operation of the pressure chamber 5 conducted by the piezoelectric body 2. When the grooves to form the pressure chamber 5 are arranged at short intervals, the contracting volume of the pressure chamber 5 is reduced. In order to compensate the reduction of the contracting volume, the pressure chamber 5 is designed in such a manner that it is extended in a direction perpendicular to the surface of the drawing. When the length of the pressure chamber is extended, the effect of deformation of the piezoelectric body 2 distant from the nozzle 9 is delayed by the restriction of the pressure wave propagation velocity, so that the effect of deformation reaches the nozzle 9 being delayed. Therefore, it is impossible to increase the pressure sharply. In order to solve the above problems, it is possible to adopt the following means. As shown by arrows in the drawing, at first, the piezoelectric body 2, which is most distant from the nozzle 9, is deformed, and then the piezoelectric body 2, which is closer to the nozzle 9 than the most distant piezoelectric body 2, is successively deformed. Alternatively, as shown by broken lines 45 in the drawing, when the walls of the pressure chamber 5 are composed in such a manner that the volume of liquid distant from the nozzle 9 is reduced, a ratio of compression of liquid is increased on the side distant from the nozzle 9, so that the pressure of liquid can be raised higher and the contraction of the piezoelectric body can act on the ink injection more effectively.

The piezoelectric body 2 has capacitance, and the electrode has resistance. Accordingly, the piezoelectric body and the pressure chamber are equivalent to a CR circuit of distributed constants from the minute viewpoint. Accordingly, when the CR constant per unit length is made to coincide with the pressure wave propagation velocity of liquid, it is possible to realize a mode of contraction which is the same as a case in which a tube filled with liquid is pressed from one end to the other. That is, a product of a distributed resistance of the electrode and a distributed capacitance of the piezoelectric body is substantially equal to a pressure propagation velocity of a fluid in the pressure chamber. A time constant computed by an actual capacitance and resistance of the electrode is very small. Therefore, in order to make the time constant to coincide with the pressure propagation velocity, it is necessary to increase the resistance of the electrode, which can be realized when a thin film is adopted.

However, there is a strong demand for saving energy. A very small portion of energy inputted into the capacitance of the piezoelectric body 2 is used as mechanical energy, and the most energy remains in the capacitance of the piezoelectric body 2 even after the completion of mechanical output. A circuit for recovering the residual energy is disclosed in Japanese Unexamined Patent Publication Nos. 4-79277, 4-346874 and 4-288254, and its recovering ratio reaches several tens %. When consideration is given to the energy recovering circuit described above, it is not advantageous that Jule's heat is lost by increasing the resistance of the electrode, but it is advantageous that the capacitance is increased while the resistivity of the electrode is lowered so as to maintain a time constant to coincide with the propagation velocity. When it is impossible to arbitrarily determine the capacitance of the piezoelectric body 2 being restricted by the injection performance, it is effective to provide the capacitance in the additional manner. For example, a portion of the piezoelectric body 2 is cut out and filled with dielectric material 47. It is easy to arrange a film made of organic or inorganic material, the dielectric constant of which is high, at a position close to the electrode, so that a distribution of capacitance which agrees with an object can be easily composed. Since the surface of the pressure chamber 5 comes into contact with ink, it will corrode when the electrode is exposed. When an insulating material, the dielectric constant of which is high, is coated on the electrode surface and grounded via an electrically conductive ink, an objective distribution type capacitance can be composed. The thus formed capacitance corresponds to invalid electric energy, however, the apparatus performance is not affected by this invalid electric energy when it is recovered by the recovering circuit.

Concerning the formation of an electrode, it is difficult to form the electrode in a narrow groove since the uniformity can not be attained, and it is also difficult to form the electrode on an upper surface of the wall when an area of the upper surface is small. Since the dielectric constant of the piezoelectric body is not less than a number of several thousands, when a clearance or an insulating material, the dielectric constant of which is a number of one figure, is interposed between the electrode and the piezoelectric body, the thickness is increased by a ratio of the dielectric constant. Accordingly, a portion of voltage is not impressed upon the piezoelectric body and becomes invalid. When an insulating material 48 of high dielectric constant is previously coated between the piezoelectric body 2 and the electrode 6 as shown in FIG. 18, it is possible to maintain an intensity of the electric field which has been effectively impressed upon the piezoelectric body 2.

Figure 19:
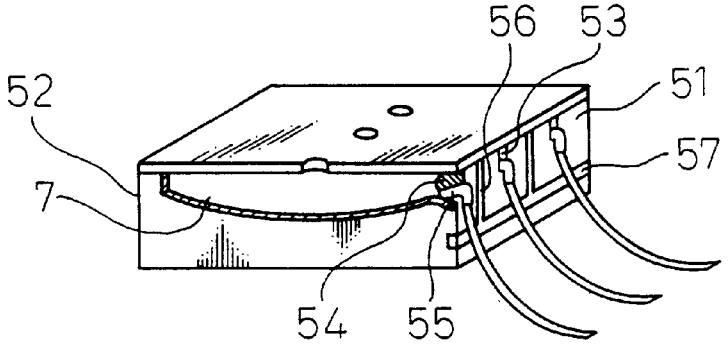
FIG. 19 is a perspective view showing a condition of wiring of the electrode of the piezoelectric pump of the present invention.
Figure 20A:
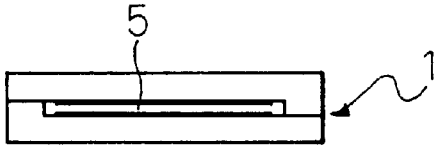
FIGS. 20(*a*) to 20(*d*) are views showing piezoelectric body blocks used in the present invention which are formed into different forms.
Figure 20B:
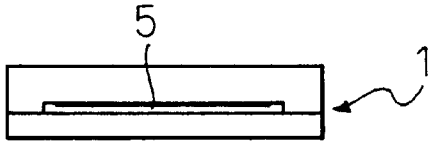
Figure 20C:
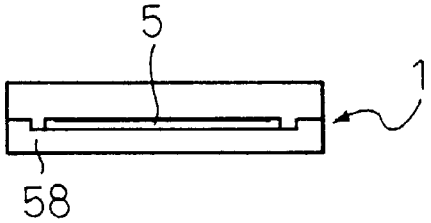
Figure 20D:
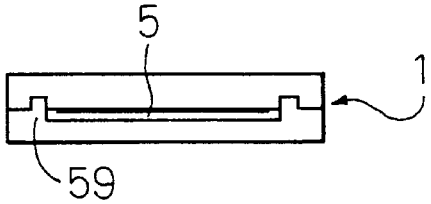

FIG. 19 is a perspective view showing a wiring condition of the electrode of the piezoelectric pump of the present invention. The pressure chamber of the piezoelectric body block or piezoelectric element used for the present invention is continuously machined while a large number of narrow grooves or slits are adjoined with each other. In this case, it is difficult to separate an electrode provided in the narrow groove from an electrode of the adjoining unit.

Therefore, the embodiment shown in FIG. 19 is arranged as follows. On one of the front wall 51 or the rear wall 52 of the pressure chamber, a shallow groove 53 is formed at a position corresponding to the wall of the adjoining unit. This groove is coated with an electrically conductive adhesive 54, and a lead wire 55 is connected to the electrode 7 formed between the walls of the adjoining units. On the other wall 52 or 51, there is formed a relatively deep groove 56 corresponding to the pressure chamber of each unit, and also there is formed a common groove 57 extending in the transverse direction. In these grooves 56, 57, an electric conductor portion of the electrode is formed by means of electrically conductive coating or plating, and connected to the electrode 6 (not shown) on the inner wall side of the pressure chamber so as to form a common electrode. In this drawing, in order to simplify the explanation, the front and the rear wall 51, 52 are shown by the same surface, however, actually, the individual electrode is attached on one side, and the common electrode is attached to the other side.

In the above embodiment of the present invention, it is necessary to form an electrode in the narrow groove or slit. When the electrode is formed in the narrow groove or slit by means of plating, it is difficult to circulate the plating solution, so that the plating can not be conducted uniformly. On the other hand, it is possible to make the piezoelectric body block 1 of a flat plate by means of extrusion. However, it is possible to form the piezoelectric body block 1 into different forms as shown in FIGS. 20(*a*) to 20(*d*). Of course, it is possible to form the piezoelectric body block 1 by cutting. It is practical to combine these various processing methods, and also it is practical to form the pressure chamber while it is opposed to a solid member.

In this case, fluid circulates between the adjoining units, however, no problems are caused as long as the circulating liquid is the same. Therefore, it is not necessary to join the clearance portion. However, there is a possibility that pressure waves propagate from the pressure chamber 5 to the adjoining unit so that the injection performance is affected. Accordingly, as shown in FIGS. 20(*a*) to 20(*d*), in order to suppress the propagation of pressure from the pressure chamber 5, it is preferable to form a labyrinth 58 or 59 so that the propagation of pressure waves can be prevented.

Figure 21A:
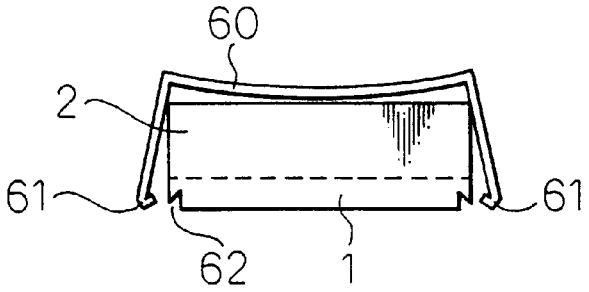
FIGS. 21(*a*) to 21(*c*) are views showing an embodiment in which pressure is previously given to the piezoelectric body block.
Figure 21B:
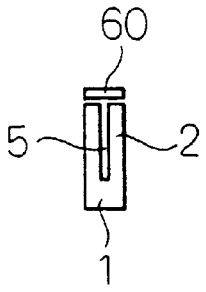
Figure 21C:
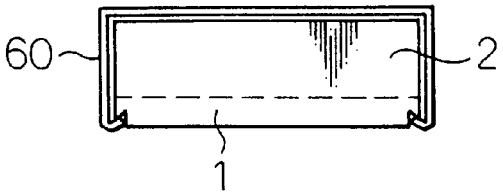

FIGS. 21(*a*) to 21(*c*) are views showing an embodiment in which pressure is previously given to the piezoelectric body block 1. The piezoelectric body is weak so that it is easily damaged when a tensile strength is applied. For this reason, it is preferable that the piezoelectric body is deformed while the stress given to the piezoelectric body is changed in a compressive condition. Accordingly, as shown in the drawings, the cover plate 60 is previously given a camber, and the clip claws 61 provided on both sides of the cover plate 60 are engaged with the cutout portions 62 on both sides of the piezoelectric block 1. In this way, substantially uniform pressure is given onto the overall surface of the piezoelectric body block 1. Not only the engagement conducted by the clip claws 61 but also the method of joining can provide the same effect. When the piezoelectric body 2 is previously given pressure in this way, the piezoelectric body 2 can be operated only in a range of compressive stress. Accordingly, the mechanical strength and the durability can be enhanced.

Figure 22:
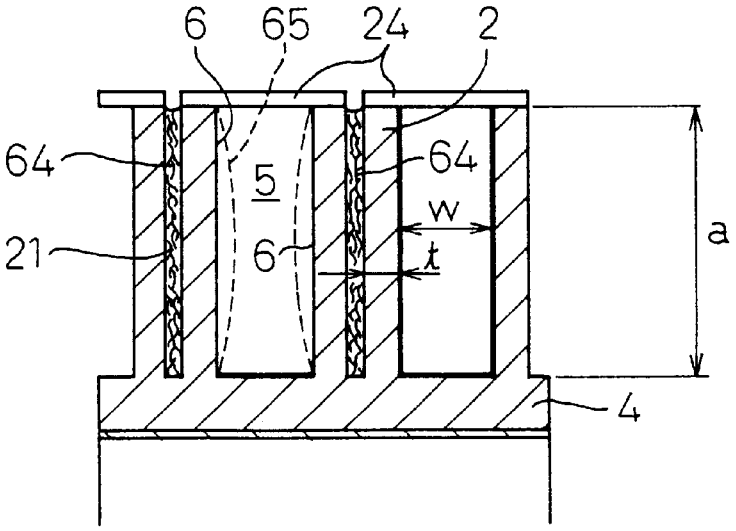
FIG. 22 is a view showing an embodiment in which the electrodes are composed of different materials and a bimorph type piezoelectric pump is used.
Figure 23A:
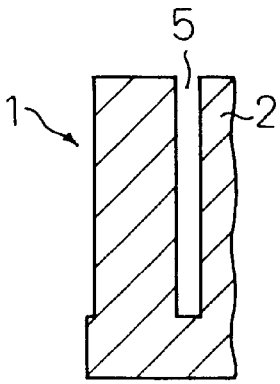
FIGS. 23(*a*) to 23(*d*) are views showing another embodiment of the bimorph type piezoelectric pump.
Figure 23B:
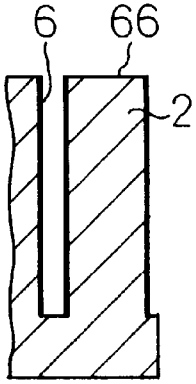
Figure 23C:
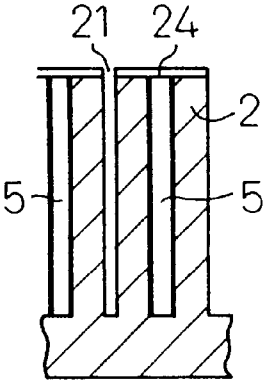
Figure 23D:
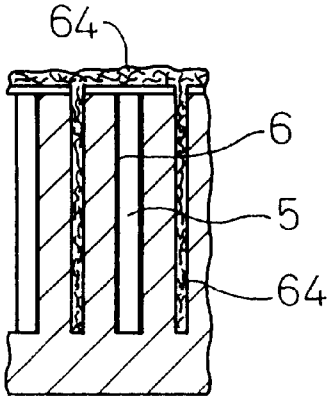

FIG. 22 is a view showing an embodiment arranged in the following manner. In the embodiment shown in FIG. 8 in which the electrodes are arranged inside and outside of the wall and in which the expansion or contraction is utilized, the electrodes are composed of different materials for providing a bimorph effect, so that an amount of contraction of the pressure chamber can be more increased. In FIG. 22, the electrode 6 provided inside the pressure chamber 5 is made of material, the rigidity of which is high, and as the electrode provided in the clearance 21 of the adjoining unit, material of low rigidity, for example, the conductive resin 64 is used. When a voltage is impressed between the electrodes 6 and 64, it is attempted that the wall thickness "t" of the piezoelectric body 2 is expanded by a distance corresponding to $d_{33}$×voltage (V), and also at the same time, it is attempted that the height of the piezoelectric body 2 is contracted by a distance corresponding to $d_{31}$×voltage (V)×a/t. Since the electrode 6 is rigid, it is not deformed so much. On the other hand, since the conductive resin 64, which is an electrode in the clearance 21 of the adjoining unit, is soft, there is provided a bimorph effect between the electrode 6 and the conductive resin 64. Therefore, the wall 2, which is a piezoelectric body, is cambered inside as shown by a broken line in the drawing. Accordingly, an amount of contraction in the pressure chamber 5 is increased.

FIGS. 23(*a*) to 23(*b*) are views showing a manufacturing method of the embodiment shown in FIG. 22, wherein the views are arranged in the order of the process. First, as shown in FIG. 23(*a*), the groove 5 which functions as a pressure chamber is formed in the piezoelectric body block 1 with a slitter (not shown). Alternatively, after the groove 5 has been formed from a green sheet by a deformed roller, it may be baked. Next, as shown in FIG. 23(*b*), a film to be used as the electrode 6 is formed inside the groove 5 by means of plating or metalizing. No electrode is provided on an upper end face 66 of the piezoelectric body 2, and as shown in FIG. 23(*c*), an insulating film 24 is attached on the upper end face 66 of the piezoelectric body 2. After that, the slit 21 is formed between the adjoining units in the piezoelectric body 2. Then, as shown in FIG. 23(*d*), another electrode 64 is formed on them by means of metalizing, plating or conductive coating. In this case, since the slit 21 is narrow, the layer thickness of plating is small, and since the rigidity of the conductive coating, which contains organic material of low rigidity, is lower than the rigidity of the electrode 6 provided on the pressure chamber 5 side, the bimorph effect can be provided as explained before.

Figure 24A:
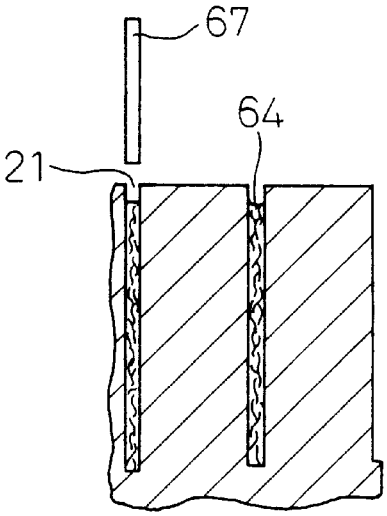
FIGS. 24(*a*) and 24(*b*) are views showing a method of forming grooves in the piezoelectric body block.
Figure 24B:
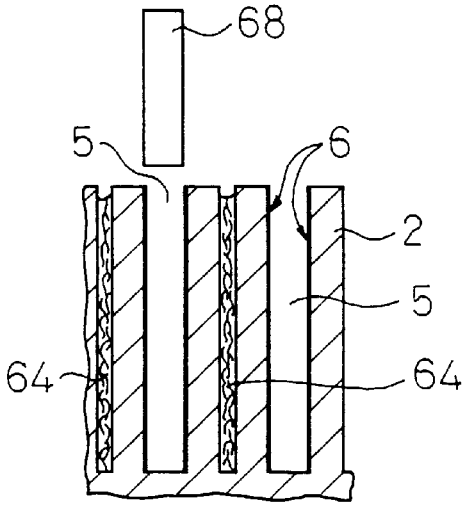

FIGS. 24(*a*) and 24(*b*) are views showing an embodiment in which the order of processing of the slit is changed. In this embodiment, first, the slit 21 on the conductive coating 64 side is formed with a cutter 67, the tool width of which is small, and this slit 21 is filled with the conductive filler 64 which is the same as the conductive coating. Then the pressure chamber 5 side is machined with a cutter 68, the tool width of which is large. In this way, the electrode 6 can be formed. Due to the foregoing, the mechanical strength of the object to be machined can be enhanced. Therefore, even in the case of delicate machining, the object is not damaged and the yield can be enhanced.

Figure 25A:
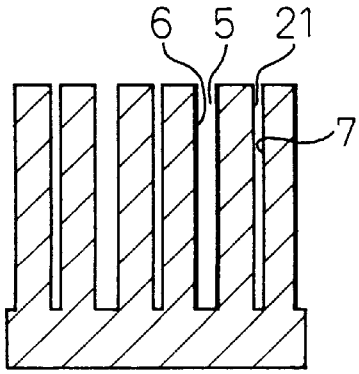
FIGS. 25(*a*) to 25(*c*) are views showing an embodiment in which plating is conducted using filler material.
Figure 25B:
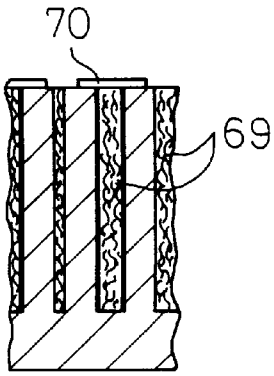
Figure 25C:
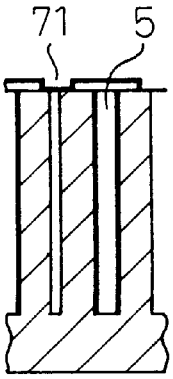
Figure 26:
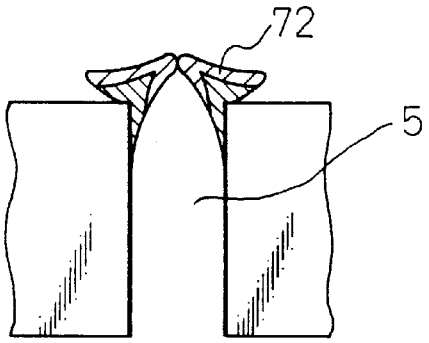
FIG. 26 is a view showing an embodiment in which a cover of the pressure chamber is formed by means of plating.

FIGS. 25(*a*) to 25(*c*) are views showing an embodiment in which the electrode is formed after the slits have been previously formed. On the inner surface of the slit 5 to be used as a pressure chamber, there is provided a relatively thick plating layer 6. In the slit 21 which is narrower than the slit 5, there is provided a thin plating layer 7. After the completion of plating, the slits 5, 21 are filled with the filler material 69. The upper surface is smoothed, and a pattern is formed by resist, and the plating layer 71 is provided. When the filler 69 is removed, the pressure chamber 5 is formed. In this case, the plating layer 6 is formed into an individual electrode, and the plating layer 7 of each unit is connected with each other by the plating layer 71, so that the plating layer 7 is formed into a common electrode. When the plating layer 71 is formed by means of electro-plating, an electric field is sharply formed on an end face of the slit 5. Accordingly, even if the filler is not put into the slit, it is possible to form a cover 72 of the pressure chamber.5 by the action of plating as shown in FIG. 26. In this case, there is provided no resist 70 at the opening portion of the slit 5.

Figure 27A:
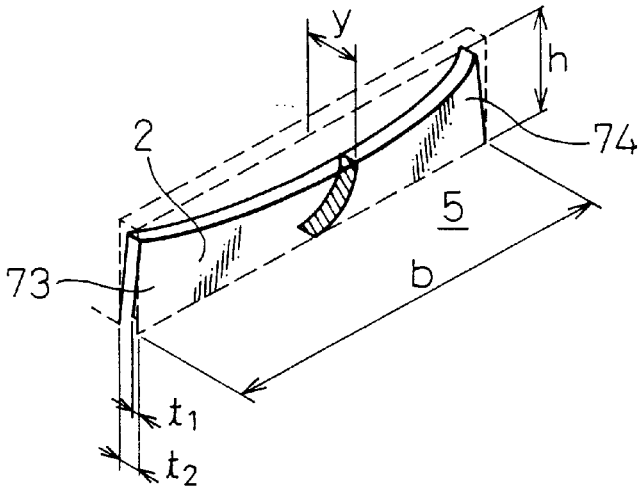
FIGS. 27(*a*) to 27(*c*) are schematic illustrations for explaining the bimorph effect of the piezoelectric body.
Figure 27B:
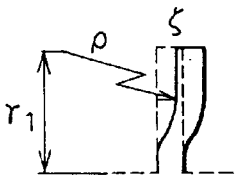
Figure 27C:
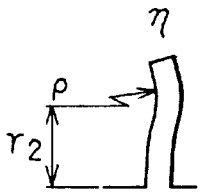

In order to provide the bimorph effect as much as possible, as shown in FIG. 27(*a*), it is preferable that an upper portion of the wall 2, which is a piezoelectric body, is cambered inside. In general, the pressure chamber 5 of the bimorph structure is composed in such a manner that both end portions 73, 74 of the two layer film 2 are fixed and the deformation is prevented. Accordingly, as shown in FIG. 27(*a*), an upper free end of the piezoelectric body is restricted from deformation. The bimorph, which is deformed by the same radius of curvature $\rho$, is shown in the cross-sectional view of FIG. 27(*b*). An amount of protrusion $\eta$ in the case where both end portions 73, 74 of the piezoelectric body 2 are fixed is shown in the cross-sectional view of FIG. 27(*c*). The amount of protrusion $\eta$ is smaller than the amount of protrusion $\xi$ in the case where both end portions of the piezoelectric body 2 are not fixed and they are maintained in a free condition. Consequently, in the embodiment shown in FIG. 24(*b*), when both end portions of the piezoelectric body 2 come into contact with organic material (conductive filler material 64) so that they are maintained in a soft condition, the upper end of the piezoelectric body 2 is free, and a large amount of deformation is allowed. Accordingly, an amount of contraction of the pressure chamber 5 is increased.

In this connection, in order to maximize the electric machine conversion efficiency, it is necessary to evaluate the product of displacement and force. When an amount of displacement is increased, an intensity of force is decreased. Accordingly, it is insufficient that only an amount of displacement is increased. The type of a piezoelectric body in which the expansion of wall thickness and the contraction in a direction parallel with the surface are directly transmitted to liquid is disadvantageous in that the efficiency is low, because the rigidity of the piezoelectric body is much higher than the rigidity of liquid, so that a force generated by the piezoelectric body is much higher than an increase of pressure caused by the contraction of liquid. Therefore, it can be said that the efficiency is low from the viewpoint in which the force is not transmitted. In the case of a piezoelectric transducer, this is explained by a concept of acoustic impedance matching. When the acoustic impedance on the piezoelectric body side is greatly different from the acoustic impedance on the liquid side, sound wave energy is reflected, so that it can not be transmitted to the liquid side. In order to solve the above problems, the piezoelectric body side is covered with soft material. In the embodiment of the present invention, in the same concept, the rigidity of the wall is lowered when the deformation caused by a camber is extended. This problem is solved when a ratio of the rigidity of the wall to the rigidity of liquid is appropriately determined in the process of design.

Figure 28:
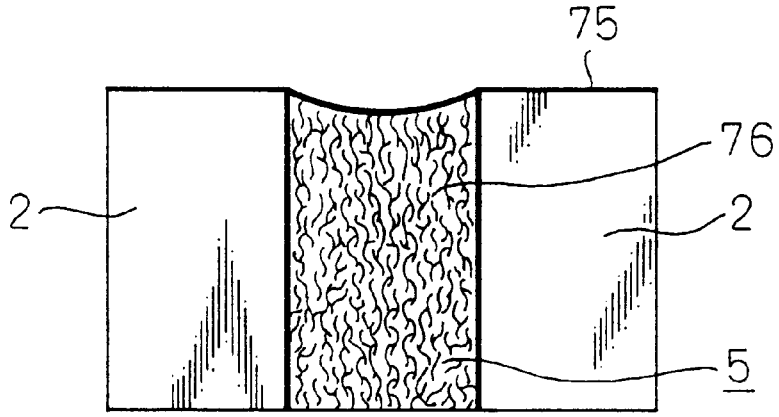
FIG. 28 is a view showing an embodiment in which the groove is filled with filler material and dents are formed on its surface.

FIG. 28 is a view showing an embodiment in which a dent is made in the shape of filler material 76 provided in the groove 5 before the plating layer 75 is provided in an upper portion of the groove 5 which is formed into a pressure chamber. In the case of flat processing, the processing ratio of the hard piezoelectric body 2 is different from the processing ratio of the soft filler material 76. Accordingly, a dent is naturally made at the center of the filler material 76. When the piezoelectric body and filler material are cooled from the processing temperature to the room temperature, the filler material 76 is more contracted by a difference of the thermal expansion coefficient. Therefore, the same dent is made at the center of the filler material 76. When plating 75 is conducted on the dent portion, the right and the left piezoelectric body 2 are connected by the dented plating film 75. Accordingly, with respect to the deformation of the piezoelectric body 2 shown in FIG. 27, it is possible for the connecting plating film 75 to be elastically curved. Therefore, the intensity of the resisting force is remarkably reduced as compared with a case in which a simple tension and compression is given between the piezoelectric bodies 2 on both sides.

Figure 29:
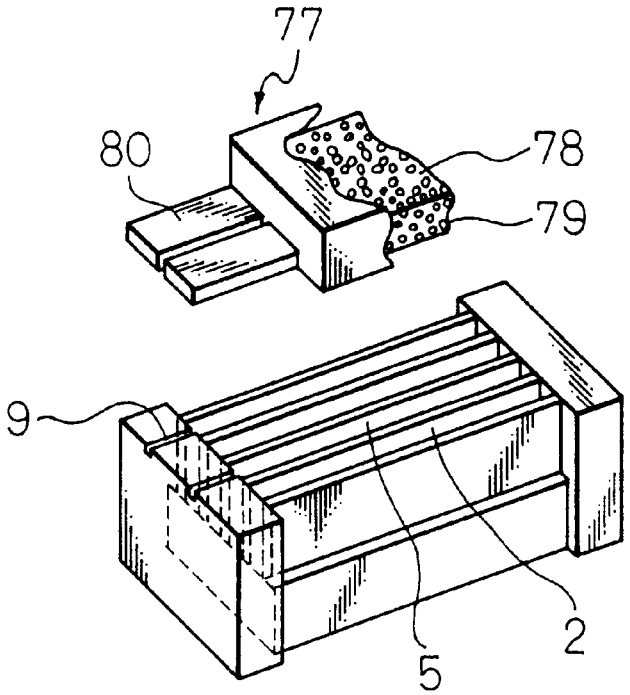
FIG. 29 is a view showing an arrangement for supplying ink to a pressure chamber formed between the walls of the piezoelectric body.

FIG. 29 is a view showing an arrangement in which ink is supplied to the pressure chamber 5 between the piezoelectric body walls 2. When the structure of the pressure chamber becomes delicate, it becomes difficult to form an ink supply passage. For the purpose of effectively utilizing a drive force, it is necessary that the passage resistance on the ink supply side is higher than the passage resistance on the nozzle 9 side from which ink is injected. On the other hand, in order to attain a high speed injection from the ink nozzle, an abundant supply of ink is required. In order to satisfy the incompatible conditions, it is advantageous to employ a system in which ink is directly supplied from a sponge-like reservoir.

An example of this system is realized by this embodiment. In this embodiment, ink is supplied when a sponge-like ink supply body 77 is pressed against a groove-shaped pressure chamber 5. Therefore, individual ink supply ports are not required. The sponge body 78 is soft, and ink oozes out from a narrow clearance. Therefore, the sponge body 78 is separate from the adjoining pressure chamber 5 by a short distance. When the soft body 78 is arranged in the pressure chamber 5, the driving pressure is disadvantageously lowered. Accordingly, a member made of fine mesh, that is, a filter mesh 79 is arranged in the pressure chamber 5 so as to remove dust from ink. The nozzle 9 portion is covered with a strong cover 80 so as to maintain high pressure of ink, and the sponge body 78 is pressed against the pressure chamber on the distant side from the nozzles 9. The shape of the groove composing the pressure chamber 5 is designed in such a manner that the passage resistance is high and the propagation velocity of pressure waves is high. Therefore, with respect to the rise of a driving force, the shape of the groove composing the pressure chamber has a throttle effect for throttling the supply passage. Accordingly, it is appropriately designed to provide a distribution constant type pressure distribution and flow rate. According to the conventional design, the ink passage is provided with a minute bulkhead, however, it is difficult to accurately position the ink passage to the opposing pressure chamber. Therefore, it is not easy to manufacture an accurate ink passage and pressure chamber. According to the arrangement of this embodiment, it is not necessary to provide such a highly accurate ink passage having a minute bulkhead. Therefore, the cost can be reduced.

Figure 30A:
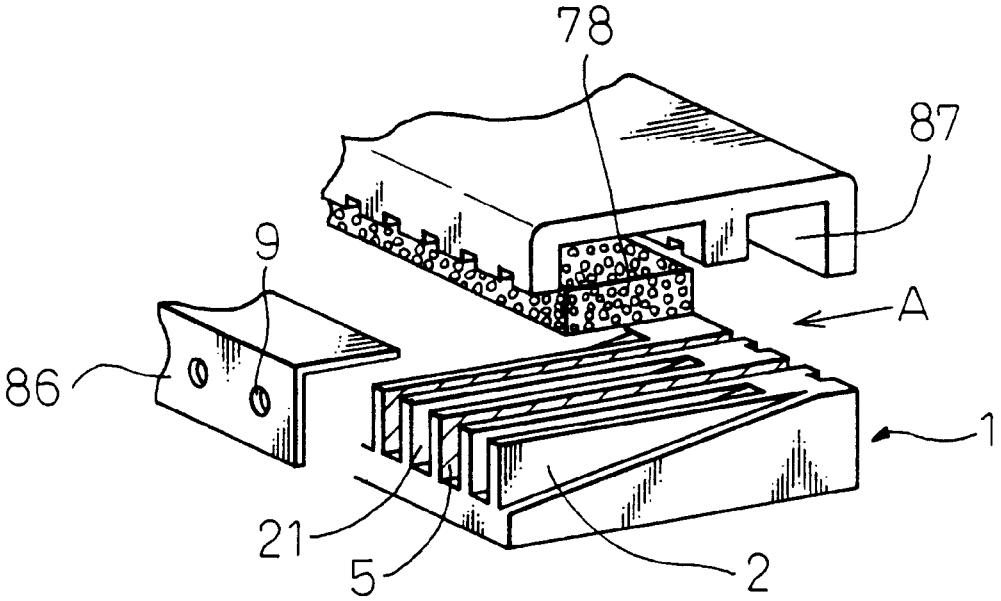
FIGS. 30(*a*) and 30(*b*) are views showing the supply of ink into the pressure chamber of the piezoelectric body block in which grooves are formed and also showing the connection of an electrode inside the pressure chamber to the outside.
Figure 30B:
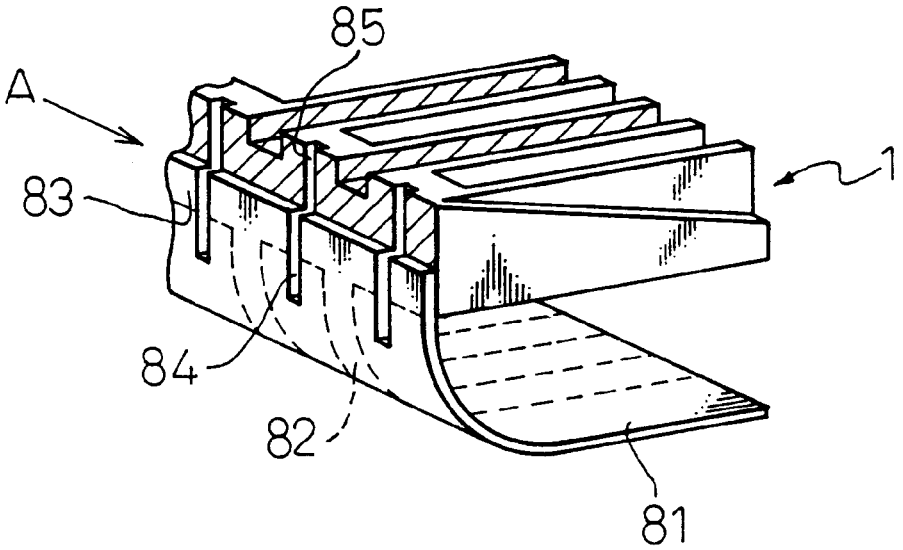

FIGS. 30(*a*) and 30(*b*) are views showing an arrangement in which ink is supplied into the pressure chamber 5 of the piezoelectric body block 1 that has been subjected to groove processing and also showing a connection of the electrode in the pressure chamber 5 with the outside. In this arrangement, the grooves are machined in the following manner. The inclination of the groove 5 composing the,pressure chamber of the piezoelectric body block 1 is different from the inclination of the groove 21 which is a clearance between the adjoining units. On the side A of the piezoelectric block 1, the grooves 5, which is one of the groove groups, have openings, and the grooves 21, which is the other of the groove groups, have no openings. The grooves 5 and the side A are subjected to plating so that an electrode is formed, and a flexible printing plate 81 is soldered onto the side A. In this flexible printing pattern 81, there is formed a conductor pattern 82, the intervals of which correspond to the intervals of the pressure chambers 5. At the end of the flexible printing plate 81, there is provided a transverse conductor portion 83 connected with the pattern 82. The flexible printing plate 81 and the side A of the piezoelectric block 1 are machined so that the slits 84, 85 can be formed at the intervals of the units. Due to the foregoing, the conductor portion 83 of the flexible printing plate 81 is separate from the electrode on the side A of the piezoelectric body block 1 for each unit. Therefore, both are insulated from each other at the same time.

The ink supplying structure of this embodiment is the same as that of the embodiment shown in FIG. 29. When a sponge-like ink impregnation body 78 is pressed against the upside of the grooves 5 composing the pressure chambers, ink can be supplied without providing individual supplying ports. In this connection, reference numeral 86 is a nozzle plate having nozzles 9 corresponding to the pressure chambers 5, and reference numeral 87 is an ink passage for supplying ink to the sponge body 78.

Figure 31A:
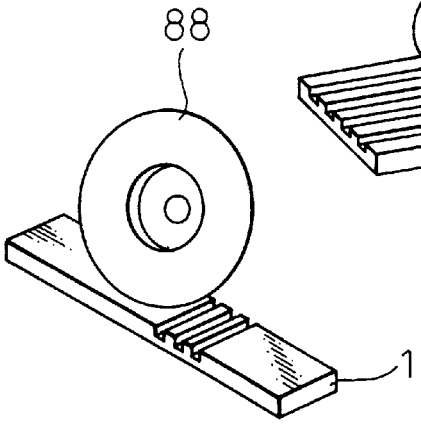
FIGS. 31(*a*) to 31(*c*) are schematic illustrations showing a method by which the grooves are formed in the piezoelectric body block.
Figure 31B:
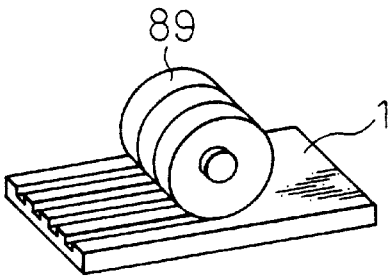
Figure 31C:
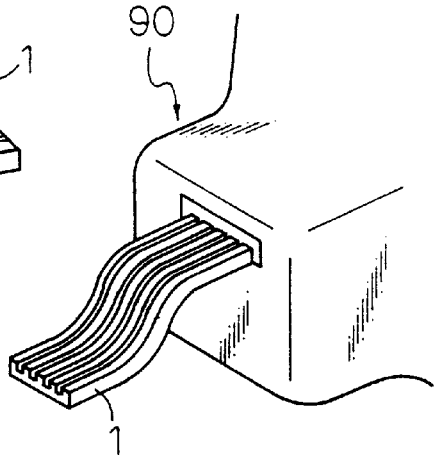

FIGS. 31(*a*) to 31(*c*) are views showing a method by which the grooves to form the pressure chambers in the piezoelectric body block are formed and also the grooves to form clearances between the adjoining units are formed. FIG. 31(*a*) is a view showing a method by which the piezoelectric body block 1 is machined so as to form the grooves. FIG. 31(*b*) is a view showing a method by which a piezoelectric green body block is previously formed, and comb-shaped grooves are continuously formed in the piezoelectric body block with a grooved roller 89, and then the piezoelectric body block is sintered. FIG. 31(*c*) is a view showing a method by which the piezoelectric green body block is extruded from an extruder 90 while grooves are formed in the piezoelectric green body block in the process of extrusion, and the piezoelectric body block is sintered after that. Of course, these processes may be combined so as to form the grooves.

Figures 32A, 32B, 32C, 32D, 32E:
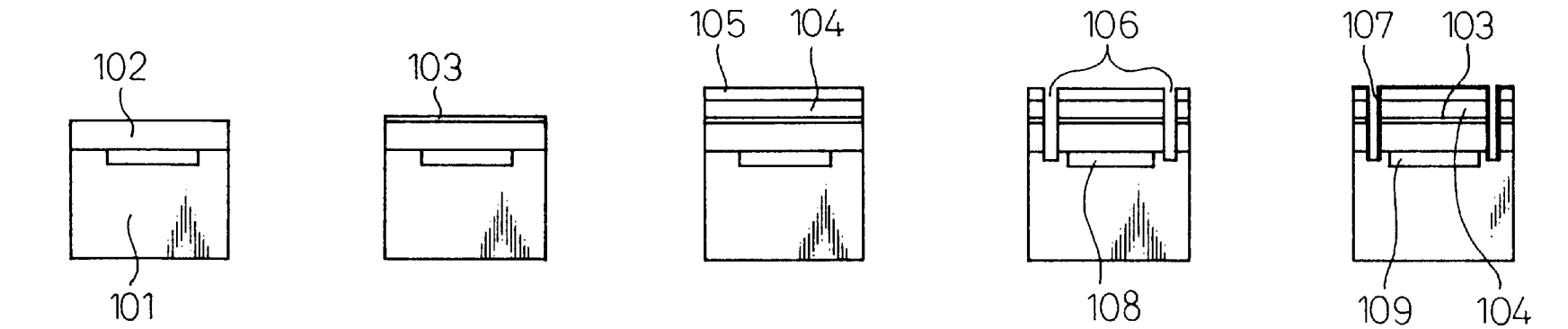
FIGS. 32(*a*) to 32(*e*) are views showing a method for forming a pressure chamber of fine structure.

FIGS. 32(*a*) to 32(*e*), 33(*a*) to 33(*e*) and 34(*a*) to 34(*e*) are views showing embodiments in which pressure chambers of fine structure can be easily formed by utilizing the high rigidity of metal.

When the drive system in which a voltage is impressed between an electrode and fluid, the energy transmission efficiency of which is high, is adopted for the arrangement in which fluid is made to come into contact with the electrode surface, there is a possibility of the occurrence of electrolysis which is not preferable. In order to avoid the occurrence of electrolysis, it is necessary to cover the electrode surface with a protective film or to maintain the electrode at the same potential as that of fluid. Since it is expensive to provide a perfect protective film on the electrode surface, the latter method, in which the electrode is maintained at the same potential as that of fluid, is useful.

When the fluid passage of fine structure is formed by means of adhesion, since adhesive attains a complete adhesion when it permeates onto a surface by its wettability, a redundant amount of adhesive flows out into the passage, so that the passage shape is deformed and further the passage is blocked in some cases. Since the pressure in the pressure chamber increases to several atm., pin holes on the surface are not allowed, and further it is necessary to provide a sufficiently high rigidity. Unless a sufficiently high rigidity is provided, the pressure chamber is expanded by the internal pressure, which reduces the effect of compression.

From the above viewpoint, it is useful to make a pressure chamber of metal, the rigidity of which is high. The process of the embodiment shown in FIGS. 32(*a*) to 32(*e*) is described below.

(a) The piezoelectric body 102 is joined onto the base plate 101.

(b) The electrode film 103 is formed on a surface of the piezoelectric body 102.

(c) On the electrode film 103, there is provided a layer 104 of resist capable of being removed by chemicals in the later process, and a metal plate 105, which will form another wall of the pressure chamber, is further placed thereon.

(d) Slits 106 are formed in the piezoelectric body 102 at positions except for the recess portion 108.

(e) The thin plating layer 107 is formed on at least the slit 106 portion. Then the resist layer 104 is removed, and the conductive coating is injected into the recess portion 108.

Since the slit 106 does not reach the recess portion 108, the conductive coating 109 is insulated from the plating layer 107 and electrode film 103. A portion from which the resist layer 104 has been removed becomes a pressure chamber, and a voltage is impressed upon the wall 102 of the piezoelectric body by the electrodes 103, 104 on both sides. In this way, a piezoelectric pump is formed.

Figures 33A, 33B, 33C, 33D, 33E:
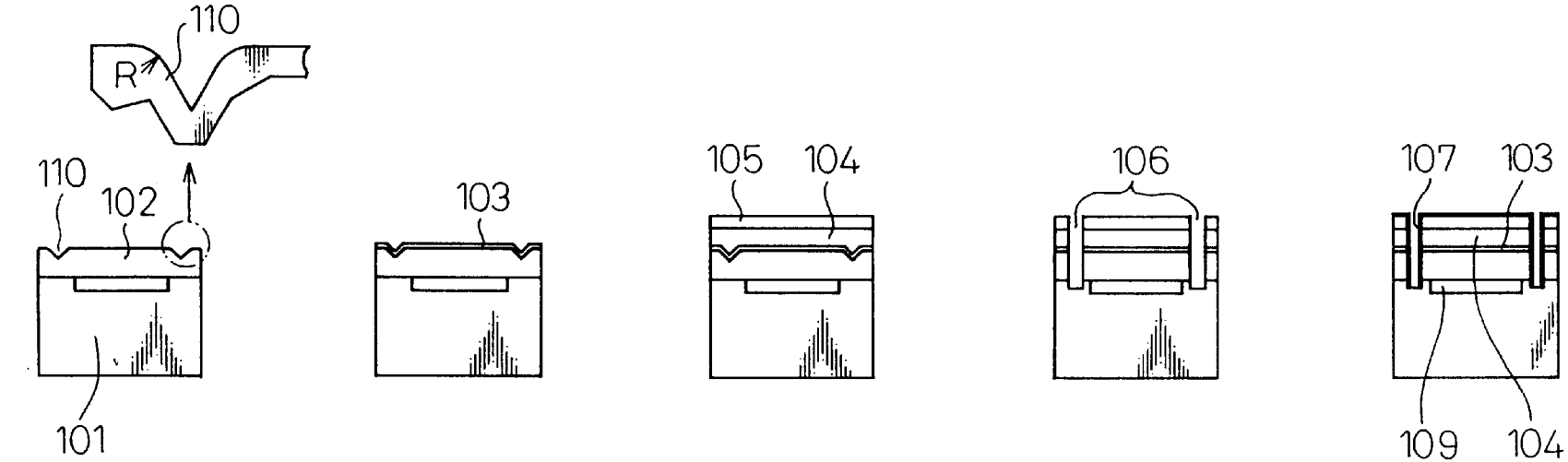
FIGS. 33(*a*) to 33(*e*) are views showing a method for forming a pressure chamber of fine structure.

In the embodiment shown in FIGS. 33(*a*) to 33(*e*), in process (a), the piezoelectric body 102 is joined onto the base plate 101, and then both corners of the portions 110 in which the slits are formed are chamfered, wherein the radius of curvature of the chamfered portion is R. After that, when the processing is conducted in the same manner as that shown in FIGS. 32(*b*) to 32(*e*), the occurrence of cracks originated from sharp edges can be reduced. In this way, the electrode 103 is strongly joined onto the plating layer 107, and the wall member 105 is also strongly joined onto the plating layer 107. When the plating layer 107 is grounded, that is, when the plating layer 107 is connected with the common electrode, it may be used in common with the plating layer of the adjoining unit, and it is not necessary to insulate the plating layers between the units.

Figures 34A, 34B, 34C, 34D, 34E:
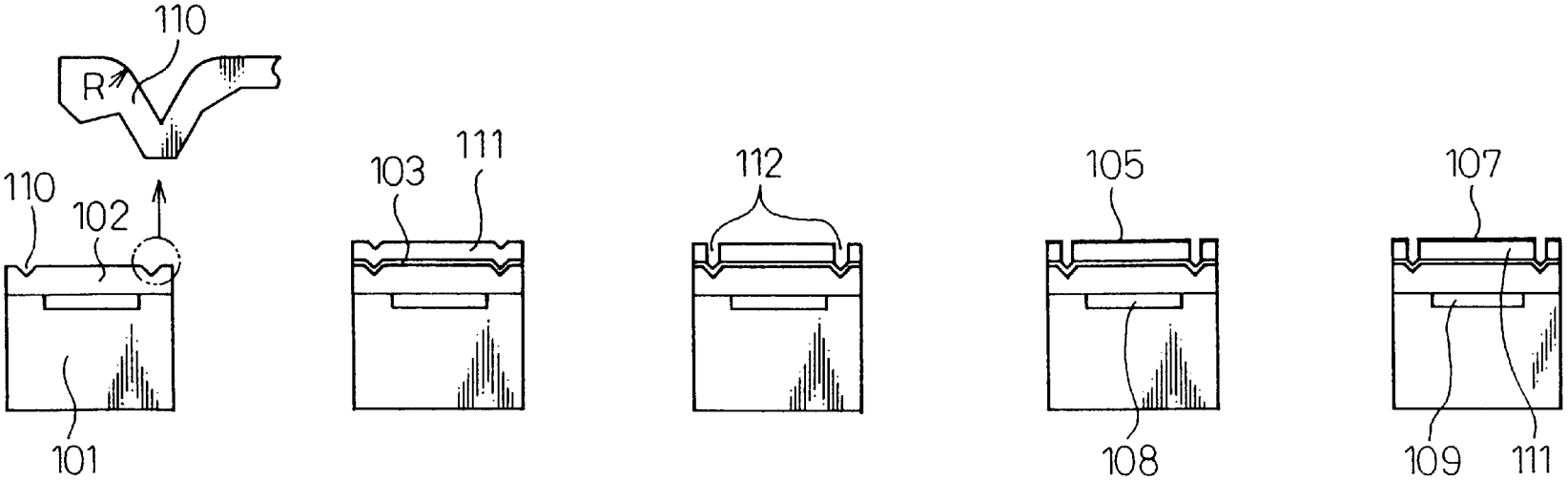
FIGS. 34(*a*) to 34(*e*) are views showing a method for forming a pressure chamber of fine structure.

In the embodiment shown in FIGS. 34(*a*) to 34(*e*), the process shown in FIG. 34(*a*) is the same as that of the above embodiment. In the process shown in FIG. 34(*b*), after the electrode film 103 has been formed on the surface of the piezoelectric body 102, patterning is conducted by the photosensitive resist layer 111. In the process shown in FIG. 34(*c*), the slits 112 are formed by means of exposure and etching. In the process shown in FIG. 34(*d*), on the photosensitive resist 111, the adhesive metallic film 105 is formed by means of spattering. Further, in the process shown in FIG. 34(*e*), the plating layer 107 is provided on the metallic film 105 so as to increase the film thickness, and the photosensitive resist layer 111 is removed, and this portion from which the photosensitive resist layer 111 is removed is used as a pressure chamber in the same manner as that of the above embodiment.

In the embodiments shown in FIGS. 32(*a*) to 32(*e*), 33(*a*) to 33(*e*) and 34(*a*) to 34(*e*), there is provided a groove or recess 108 on the base plate 101 side, and the individual driving electrode is accommodated in the slit or the recess. In the case where the groove or the recess 108 is previously formed on the base plate 101 and joined to the piezoelectric body 102 so as to make a closed space, opening portions are formed in the front and the rear direction. After the plating 107 has been completed, a fluid conductor such as a conductive coating 109 is injected into the recess 108 from the opening end of the recess 108. The conductive coating 109 is used as an individual electrode, the voltage of which is changed. In this case, the individual electrode is completely insulated from the fluid, so that the stability is sufficiently high. Another object of this embodiment is described as follows. Since the fluid conductor 109 is composed of an elastic component such as organic material, the deformation of the piezoelectric body 102 can be effectively put into practical use. In this embodiment, the plating layer 107 is not provided in a small region, but a thick plating layer 107 is formed at corner portions on the outermost circumference as shown in the drawing. Accordingly, there is a tendency that the rigidity of the upper surface is increased. Wall thickness of the sides of the slits 106, 112 is small, however, only tension acts on the sides of the slits 106, 112. Accordingly, even if the wall thickness is small, the rigidity is sufficiently high. When the plating is completed before clearances (not shown) between the units are joined to each other, interference of mechanical oscillation caused by the adjoining units can be reduced.

Figure 35:
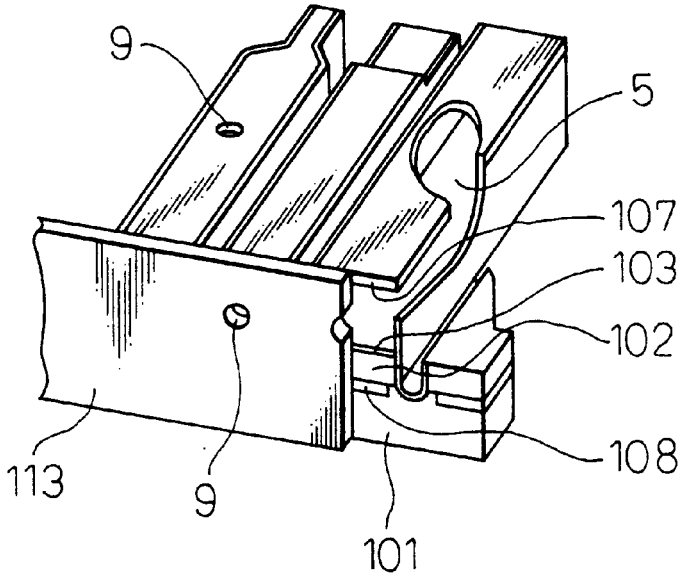
FIG. 35 is a partially exploded perspective view of the piezoelectric pump manufactured by the method shown in FIGS. 32(*a*) to 32(*e*), FIGS. 33(*a*) to 33(*e*), and FIGS. 34(*a*) to 34(*e*).

FIG. 35 is a partially exploded perspective view of the piezoelectric pump manufactured in the manner described above. In FIG. 35, there are shown three different types pressure chambers 5. That is, in the pressure chamber on the right, both the thickness and the width are constant, however, in the pressure chamber located at the center, there is provided a step portion in the thickness direction so that the passage can be reduced. In the pressure chamber on the left, the rear passage is reduced in the width direction. In the above embodiment, it is possible to form an arbitrary plane shape of the pressure chamber when the resist layer 111 is made of photosensitive material and the shape pattern is formed in the plane direction by means of lithography. When a plurality of resist layers are formed, it is possible to form a shape in which the thickness is partially changed. In this connection, the nozzle 9 is joined in the vertical direction, however, the nozzle 9 may be previously formed on the wall of the metallic plate 113.

Figure 36:
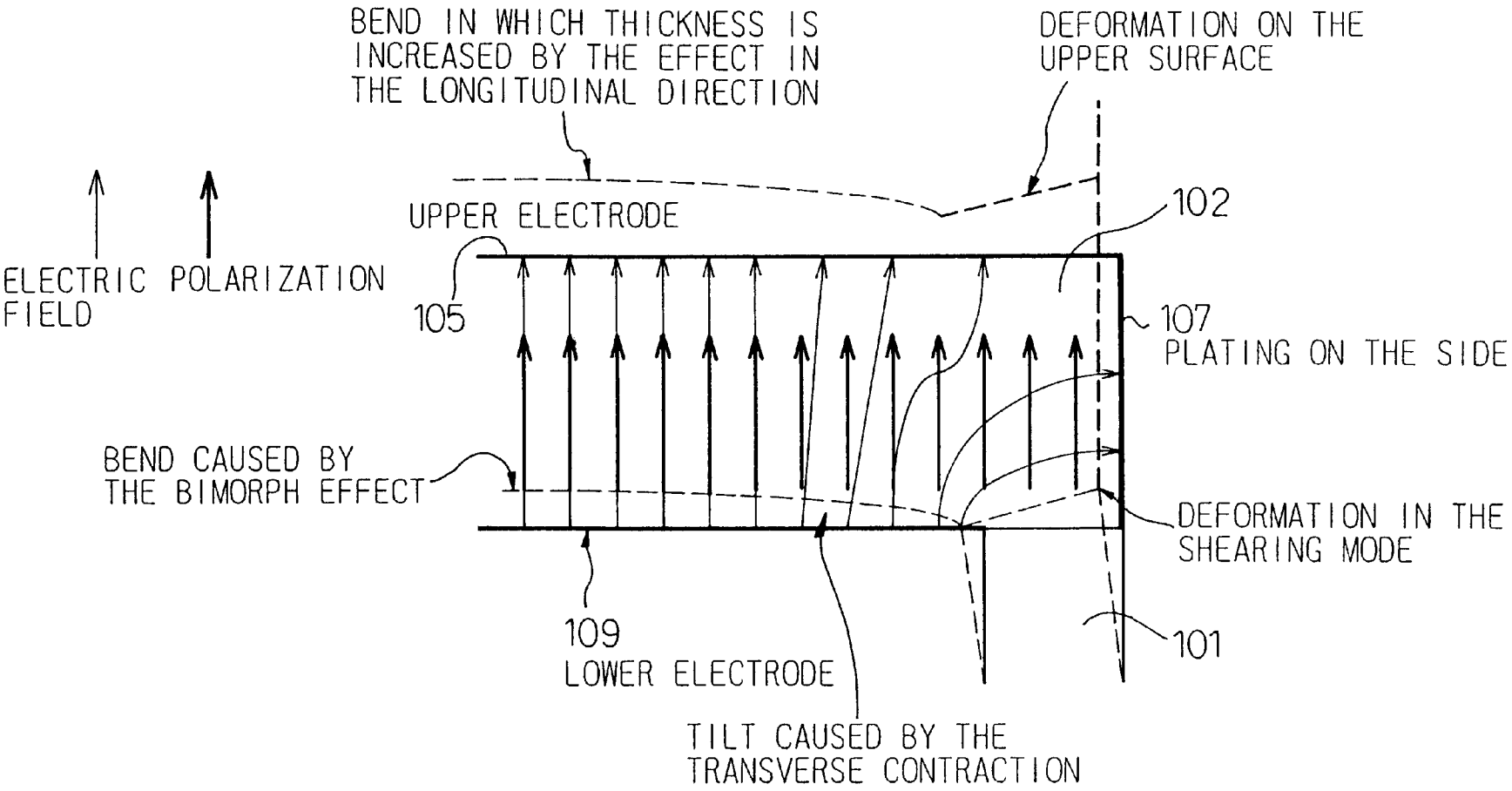
FIG. 36 is a schematic illustration for explaining the deformation of the piezoelectric body formed by the method shown in FIGS. 32(*a*) to 32(*e*), FIGS. 33(*a*) to 33(*e*), and FIGS. 34(*a*) to 34(*e*).

FIG. 36 is a schematic illustration for explaining the deformation of the piezoelectric body 102 in the embodiments shown in FIGS. 32(*a*) to 32(*e*), 33(*a*) to 33(*e*), 34(*a*) to 34(*e*) and 35. In this case, the piezoelectric body 102 is sandwiched by a soft electrode made of conductive coating, which is the lower electrode 109, and a rigid electrode made of metal, which is the upper electrode 105. The bimorph effect can be provided by the contraction of the piezoelectric body 102 in the plane direction. Specifically, when an electric field is impressed upon the piezoelectric body 102 in the upward and downward direction which is the polarizing direction of the piezoelectric body 102, the thickness of the center is increased, and at the same time the piezoelectric body 102 is contracted in the plane direction. When the piezoelectric body 102 is contracted, a resisting force is given to the piezoelectric body 102 by a joint portion where the piezoelectric body 102 is joined to the base plate 101. However, the joint portion is composed of a small wall, and the outside is a space and the inside is a soft conductive coating. Accordingly, the wall can be easily tilted, and an intensity of the resisting force is low. Together with an increase of the thickness of the piezoelectric body 102, the contraction of the piezoelectric body 102 in the plane direction is obstructed by the rigidity of the upper electrode 105. As a result, as shown by a broken line in the drawing, there is formed a convex camber. In other words, the bimorph effect is provided. Both the increase of thickness and the contraction in the plane direction contract the pressure chamber.

On the right of the piezoelectric body 102, the electric field crosses the polarizing direction obliquely. Under the above condition, the piezoelectric body 102 is deformed in the shearing mode. This deformation increases the contraction of the pressure chamber. According to the conventional method, only a deformation of the piezoelectric body caused in a single direction is utilized. However, in this embodiment, a deformation simultaneously caused in the perpendicular direction is utilized, and a deformation caused in the shearing mode is also utilized.

Figure 40:
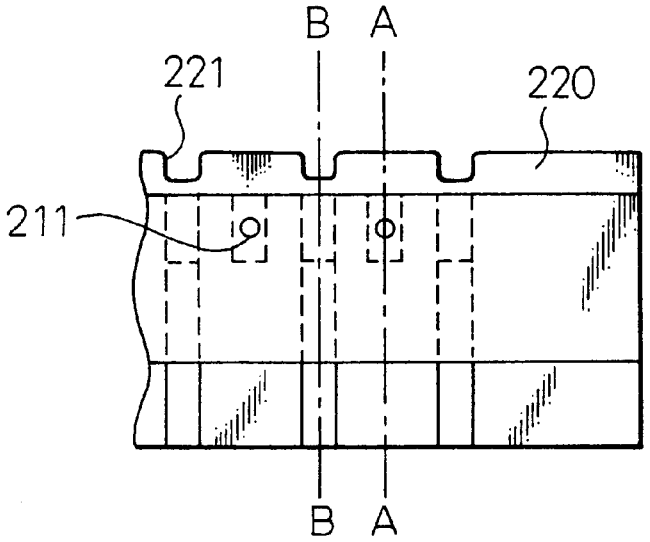
FIG. 40 is a cross-sectional view taken on line C—C in FIG. 37.
Figure 37:
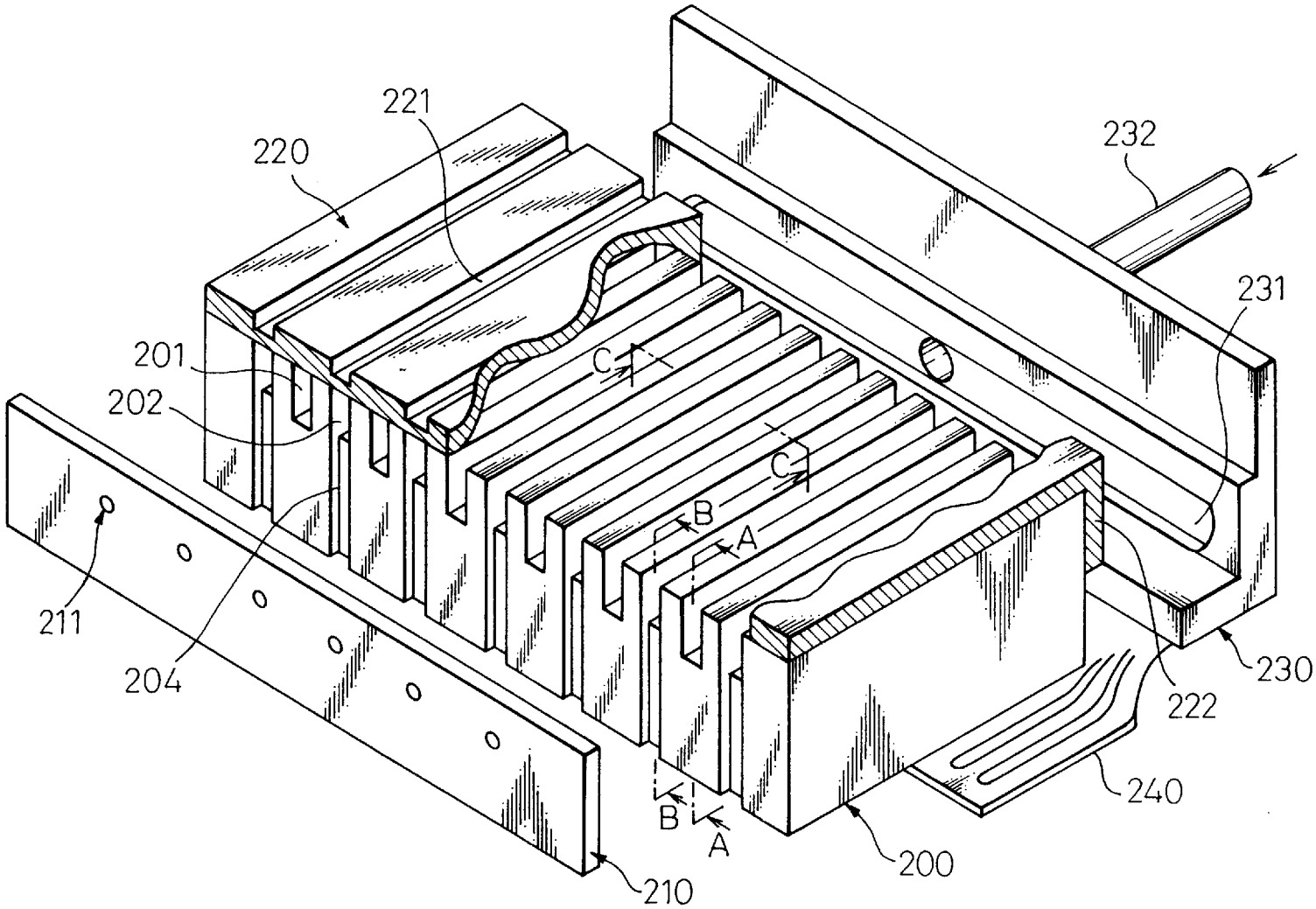
FIG. 37 is a partially exploded perspective view showing an overall arrangement of the specific embodiment of the piezoelectric pump of the present invention, wherein the view is taken from the nozzle side.
Figure 38:
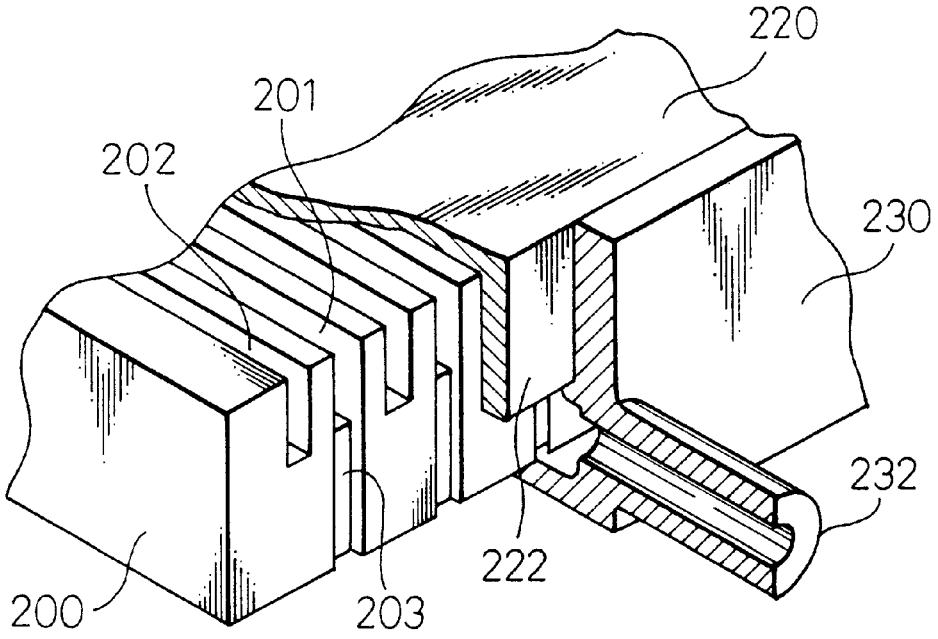
FIG. 38 is a partially exploded perspective view of the piezoelectric pump of the present invention, wherein the view is taken from the ink supply port side.
Figure 39:
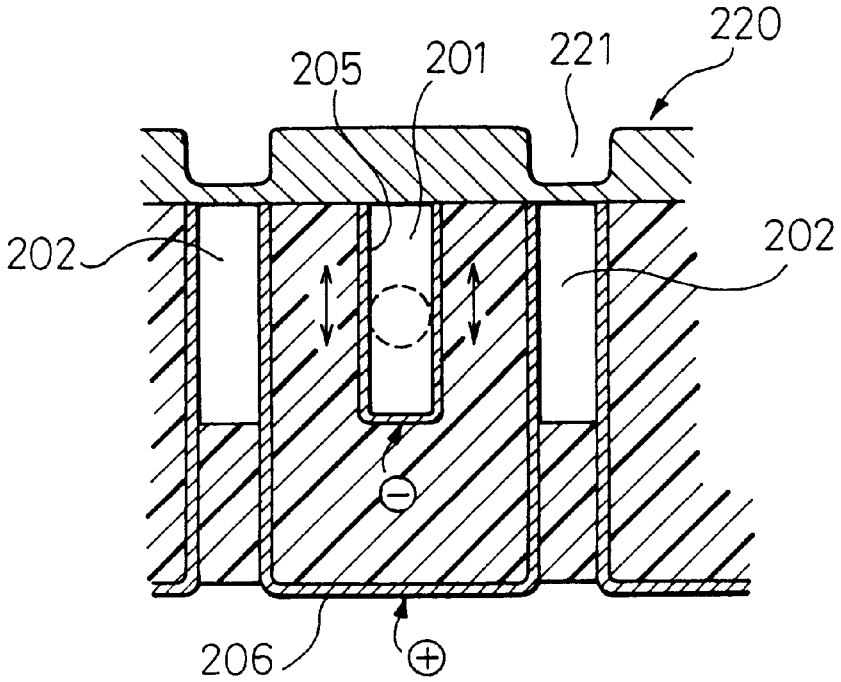
FIG. 39 is a cross-sectional view showing an arrangement of the electrode of the embodiment shown in FIG. 37.
Figure 41A:
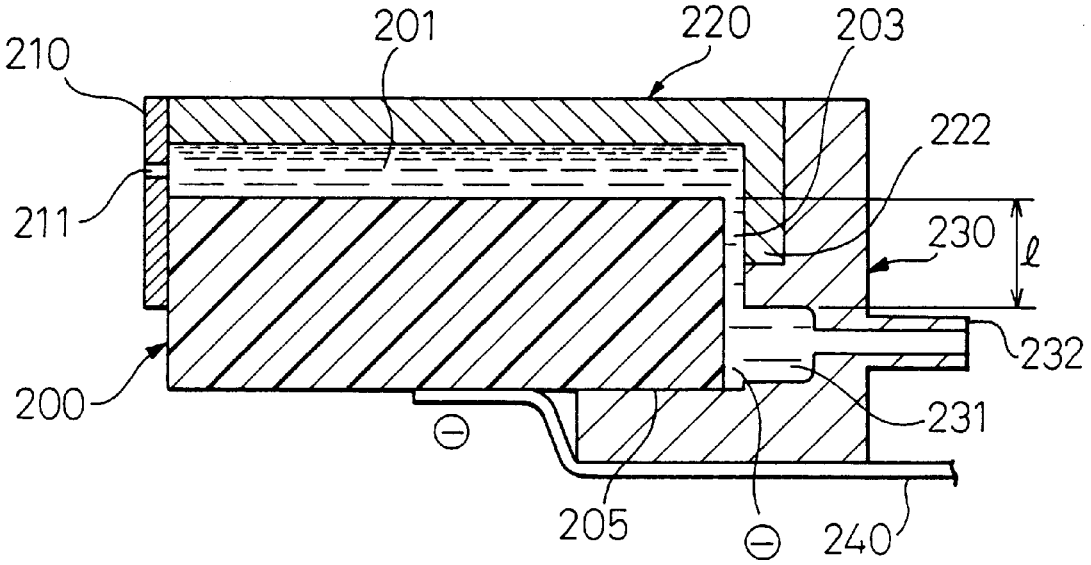
FIGS. 41(*a*) and 41(*b*) are cross-sectional views taken on line A—A in FIGS. 37 and 40.
Figure 41B:
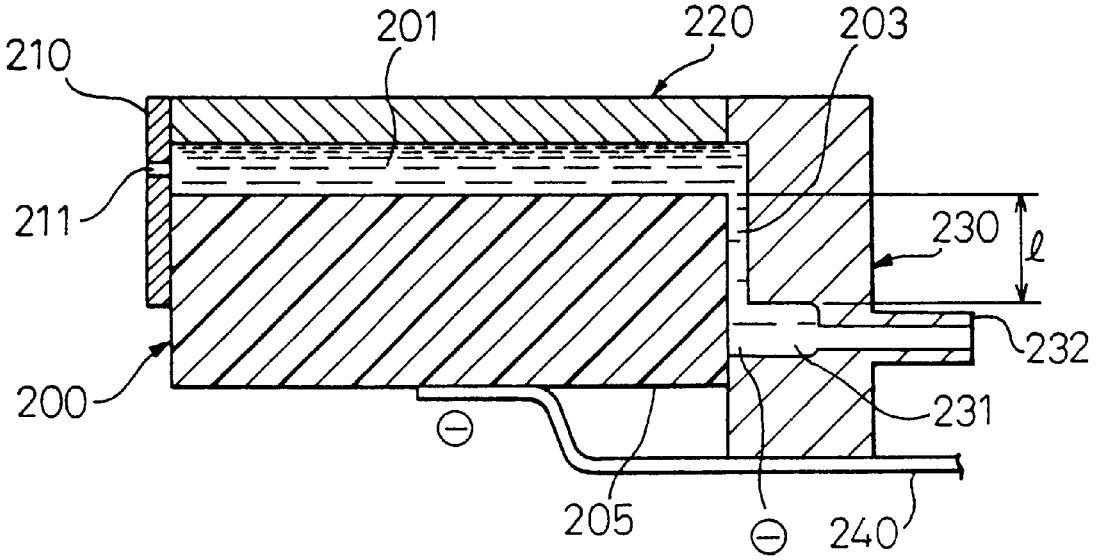
Figure 42:
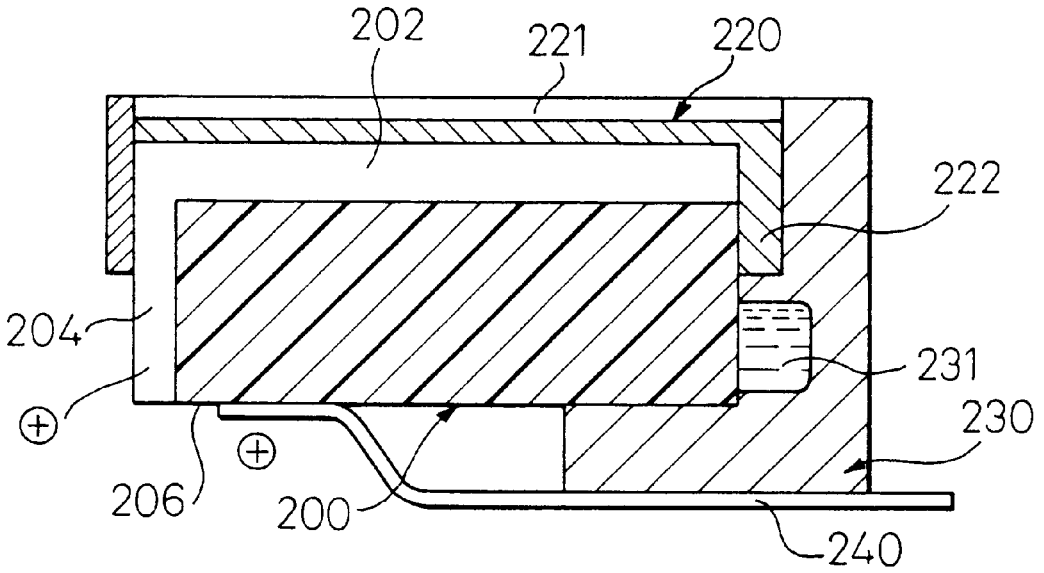
FIG. 42 is a cross-sectional view taken on line B—B in FIGS. 37 and 40.
Figure 43:
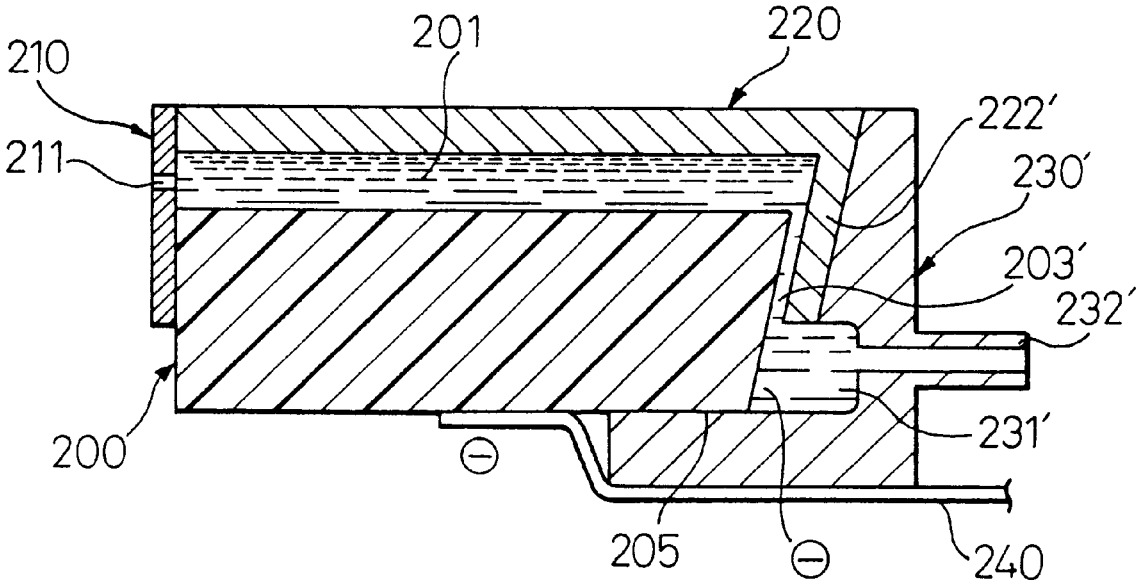
FIG. 43 is a cross-sectional view corresponding to FIG. 41 in which a variation of the piezoelectric pump of the present invention is shown.

FIGS. 37 to 43 are views showing a specific embodiment of the piezoelectric pump of the present invention. FIG. 37 is a partially exploded perspective view showing an overall arrangement of the specific 5 embodiment of the piezoelectric pump of the present invention, wherein the view is taken from the nozzle side. FIG. 38 is a partially exploded perspective view of the piezoelectric pump of the present invention, wherein the view is taken from the ink supply port side. FIG. 39 is a cross-sectional view showing an arrangement of the electrode of the embodiment shown in FIG. 37. FIG. 40 is a cross-sectional view taken on line C—C in FIG. 37. FIG. 41 is a cross-sectional view taken on line A—A in FIGS. 37 and 40. FIG. 42 is a cross-sectional view taken on line B—B in FIGS. 37 and 40. FIG. 43 is a cross-sectional view corresponding to FIG. 41 in which a variation of the piezoelectric pump of the present invention is shown.

In FIG. 37, reference numeral 200 is a piezoelectric body block, reference numeral 210 is a nozzle plate, reference numeral 220 is an upper cover, reference numeral 230 is an ink supply metallic member, and reference numeral 240 is a flexible printing plate.

On an upper surface of the piezoelectric body block 200, there are provided a groove 201 for forming a pressure chamber, and a groove 202 arranged between the adjoining units, wherein the grooves 201 and 202 are alternately arranged in the horizontal direction. On a rear surface of the piezoelectric body block 200, that is, on an end surface of the ink supply metallic member 230, there is vertically provided a groove 203 which is connected with the groove 201 for forming the pressure chamber (shown in FIG. 38). On the other hand, on a front surface of the piezoelectric body block 200, that is, on an end surface of the nozzle plate 210, there is provided a groove 204 which is connected with the groove 202 provided between the adjoining units.

The nozzle plate 210 is joined onto the front surface of the piezoelectric body block 200. On the nozzle plate 210, there are formed nozzle holes 211 at positions corresponding to the pressure chambers 201 of the piezoelectric body block 200. An upper cover 220 is joined onto an upper surface of piezoelectric body block 200. Thickness of a portion 221 of the upper cover 220 corresponding to the groove 202 between the adjoining units is reduced. On the rear side, that is, on the side of the ink supply metallic member 230, the upper cover 220 has a bent portion 222. This bent portion 222 is joined onto the rear surface of the piezoelectric block 200.

The ink supply metallic member 230 is joined onto the rear surface of the piezoelectric body block 200. In the ink supply metallic member 230, there is formed a common ink chamber 231 extending in the transverse direction. When the ink supply metallic member 230 is joined onto the rear surface of the piezoelectric body block 200, this common ink chamber 231 communicates with the grooves 203 which are connected to the pressure chambers 201. At the rear of the ink supply metallic member 230, there is provided an ink supply port 232 for supplying ink to the common ink chamber 231.

FIG. 39 is a view showing an electrode of the piezoelectric body block 200. The piezoelectric body block 200 is subjected to plating, so that the overall surface of the piezoelectric body block 200 including the groove portion is coated with a metallic plating layer. After that, the front, the upper and the rear surface of the piezoelectric body block are subjected to cutting so that the metallic layer can be removed. In a rear region on the lower surface of the piezoelectric body block 200, that is, in a region on the ink supply metallic member 230 side, a pattern is formed by means of well known etching so that an individual electrode 205 (shown in FIGS. 41(*a*) and 41(*b*)) can be formed for communicating with an inner face of the pressure chamber 201 and an inner face of the groove 203 connected with the pressure chamber 201. On the other hand, in a front region on the lower surface of the piezoelectric body block 200, that is, in a region on the nozzle plate 210 side, a pattern is formed by means of well known etching so that a common conductor region 206 (shown in FIG. 42) can be formed for communicating with an inner face of the groove 202 between the adjoining unit and an inner face of the groove 204 connected with the groove 202.

On the inner face of the pressure chamber 201 including the inner face of the groove 203, one of the electrodes (negative pole) is formed, and on the inner face of the groove 202 between the adjoining units including the inner face of the groove 203, the other electrode (positive pole) is formed. These electrodes are respectively connected to the individual electrode 205 on the lower surface of the piezoelectric body block 200 and the common electrode 206. The individual electrode 205 and the common electrode 206 are respectively connected to predetermined conductor patterns provided on the flexible printing plate 240 (FIGS. 41(*a*), 41(*b*) and 42).

The individual electrode 205 capable of impressing a voltage upon each pressure chamber 201 is drawn out from the rear side of the piezoelectric body block 200, and the common electrode 206 which is common among the pressure chambers 201 is drawn out from the front side of the piezoelectric body block 200. By the individual electrode 205 and the common electrode 206 described above, an arbitrary pressure chamber 201 can be operated through the flexible printing plate 240.

As shown in FIGS. 41(*a*) and 41(*b*), the front portion of the pressure chamber 201 is closed by a nozzle plate 210 having nozzle holes 211, and the upper portion of the pressure chamber 201 is closed by an upper cover 220, and the rear portion of the pressure chamber 201 is communicated with the groove 203. The upper cover 220 may be a L-shaped plate as shown in FIG. 41(*a*) or may be a flat plate as shown in FIG. 41(*b*). This groove 203 extends downward in a direction perpendicular to the pressure chamber 201 arranged in the horizontal direction, and the lower portion of the groove 203 is communicated with the common ink chamber 231. That is, a portion of the groove 203, the length of which is l, composes a throttle for the ink chamber 201. The width and depth of the section of the groove 203 and the length l are determined so that an appropriate throttle effect can be provided.

As described above, the inner wall of the pressure chamber 201 is composed of a conductive layer, which is used as an individual electrode 205 and connected to the flexible printing plate 240. On the other hand, the inner wall of the groove 202 between the adjoining units is used as a common electrode and connected with the flexible printing plate 240 via the inner wall of the groove 204.

Accordingly, when a predetermined pressure chamber 201 is driven, a voltage is impressed between the individual electrode 205 concerned and the common electrode 206 via the flexible printing plate 240. Due to the foregoing, a potential difference is caused between both side walls of the pressure chamber 201 in the piezoelectric body block 200. Therefore, both side walls of the pressure chamber 201 are displaced in the same direction, for example, in the direction of contraction.

A portion 221 of the upper cover 220, the thickness of which is reduced, is arranged at a position corresponding to the groove 202 formed between the units. This thin portion 221 absorbs a strain caused between both side walls of a specific pressure chamber 201 and the walls of the adjoining pressure chambers when both side walls of the specific pressure chamber 201 are contracted or expanded.

When both side walls of the pressure chamber 201 are on the contraction side, pressure in the pressure chamber 201 is quickly increased, and the pressure waves propagate to both the front nozzle 211 side and the rear side. However, the rear side of the pressure chamber is bent at a right angle by the groove 203. Therefore, the pressure waves are reflected on the rear wall and returned to the front nozzle side.

Although a quantity of ink, which is fluid, is very small, it has a mass. Therefore, a predetermined period of time is required for ink to be accelerated to a predetermined injection speed when ink is injected from the nozzle hole 211. However, the rear side of the pressure chamber 201 is bent at a right angle by the groove 203, and further the ink flow is throttled by the section of the groove 203. Accordingly, ink can be maintained in the pressure chamber until the ink pressure is increased to a value necessary for injection.

Therefore, ink accommodated in the pressure chamber 201 can be injected from the front nozzle hole 211 at a sufficiently high injection speed. On the other hand, on the rear side of the pressure chamber 201, as described above, propagation of the pressure waves is greatly reduced. Therefore, pressure loss of ink is reduced, and the common pressure chamber 231 is seldom affected by the pressure in the pressure chamber 201.

When the impression of voltage upon the individual electrode 205 and the common electrode 206 is stopped, both side walls of the pressure chamber 201 in the piezoelectric body block 200 are expanded and returned to the initial condition. At this time, the pressure in the pressure chamber 201 becomes negative, and ink in the common ink chamber 231 is absorbed by the pressure chamber 201 concerned via the groove 203 having a throttle effect. In this case, it is not necessary to excessively reduce a cross-sectional area of the groove 203 which composes a throttle, because it is possible to provide a necessary throttle effect by the flow passage shape which is bent at right angle as described above. Therefore, the flow passage resistance can be maintained low when ink is sucked from the common ink chamber 231 into the pressure chamber 201.

When the ink flow passage is composed as described above, the nozzle plate 210, the upper cover 220 and the ink supply metallic member 230 can be easily manufactured, and these parts can be accurately combined with the piezoelectric body block 200. In this way, it is possible to compose an ink jet head of high accuracy. Further, the ink injection speed can be increased and printing property can be enhanced.

FIG. 43 is a cross-sectional view corresponding to FIG. 41 in which a variation is shown. In this variation, a groove 203' arranged at the rear of the pressure chamber 201 is bent at an acute angle with respect to the pressure chamber 201 arranged in the horizontal direction. Due to the foregoing arrangement, the throttle effect of the groove 203' can be more enhanced. Even if the cross-sectional area of the groove 203' is increased, the ink flow passage resistance can be more reduced when ink is sucked from the common ink chamber 231 to the pressure chamber 201 while the pressure in the pressure chamber 201 is maintained at a predetermined value.

The angle of the groove 203' is determined at an appropriate value so that a sufficiently high throttle effect can be provided in relation with the cross-sectional area of the flow passage and the length l. In this connection, the shapes of a rear bent portion 222' of the upper cover 220 and an ink supply metallic member 230' are determined in accordance with the angle of the groove 203'.

It should be understood by those skilled in the art that the foregoing description relates to only preferred embodiments of the disclosed invention, and that various changes and modifications may be made to the invention without departing from the spirit and scope thereof.

What we claim is:

1. A piezoelectric fluid pump comprising:

a stationary pump base;

a plurality of piezoelectric elements arranged in parallel on said stationary pump base, each of said piezoelectric elements having in a direction perpendicular to a polarizing direction of said piezoelectric elements, a first end fixed to said stationary pump base and a free, second end;

connecting means for at least physically connecting said free, second ends of respective pairs of adjacent ones of said piezoelectric elements to each other, for respective units of the fluid pump; and pressure chambers, each defined between said pairs of adjacent piezoelectric elements and between said stationary pump base and said connecting means, so that there are gaps between walls of said piezoelectric elements and walls of piezoelectric elements of adjacent units; wherein said stationary pump base and said plurality of piezoelectric elements are formed of a unitary piezoelectric block;

first, inner electrodes are provided on inner surfaces of said pairs of adjacent piezoelectric elements, between which said pressure chamber is defined;

second, outer electrodes are provided on outer surfaces of said pairs of adjacent piezoelectric elements, exterior to said pressure chamber;

said second, outer electrodes are formed by depositing conductive thin films on inner surfaces of said gaps; and said piezoelectric block is provided with intermediate slits for electrically isolating said second, outer electrodes of a certain unit from second, outer electrodes of adjacent units.

2. A piezoelectric fluid pump as set forth in claim 1, wherein said pressure chambers are defined by a unitary piezoelectric block having grooves which are formed by a mechanical process.

3. A piezoelectric fluid pump as set forth in claim 2, wherein said grooves are formed by a slit-machining process or an extrusion molding process.

4. A piezoelectric fluid pump as set forth in claim 1, wherein said piezoelectric block has at least one end surface, on which a transverse slit is provided along a direction perpendicular to said intermediate slits;

at least said inner surfaces of the gaps and said end surface of the piezoelectric block are plated with said conductive thin film;

said end surface of the piezoelectric block is polished so that the plated thin conductive film thereon is removed, thus said first, inner electrodes are electrically isolated from said second, outer electrodes on outer walls of said pair of piezoelectric elements;

said second, outer electrodes of said pairs of piezoelectric elements, between which said pressure chamber is defined, are electrically connected to each other through said plated thin conductive film formed in said transverse slit.

5. A piezoelectric fluid pump as set forth in claim 1, wherein said piezoelectric block is provided, between adjacent units, with said gaps which are also formed by a mechanical process.

6. A piezoelectric fluid pump as set forth in claim 5, wherein said gaps defined between adjacent units are filled with elastic material.

7. The piezoelectric fluid pump as set forth in claim 5, wherein said mechanical process is one of a slit-machining process or an extrusion molding process.

8. A piezoelectric fluid pump as set forth in claim 1, wherein said first electrode is made of a relatively rigid material, and said second electrode is made of a relatively deformable material.

9. The piezoelectric fluid pump as set forth in claim 8, wherein said first electrode comprises a metal plate coated on said inner surfaces of said pair of piezoelectric elements and said second electrode comprises a conductive paste filled in said gaps.

10. A piezoelectric fluid pump as set forth in claim 1, wherein a piezoelectric block is subjected to slit-machining process or shape-extrusion molding process to form a plurality of units of the piezoelectric fluid pump including a plurality of grooves constituting said pressure chambers and said a plurality of said gaps alternately arranged; and closing members are adjoined to respective ends of said piezoelectric block to form closed pressure chambers.

11. A piezoelectric fluid pump comprising:

a stationary pump base;

a plurality of piezoelectric elements arranged in parallel on said stationary pump base, each of said piezoelectric elements having in a direction perpendicular to a polarizing direction of said piezoelectric elements, a first end fixed to said stationary pump base and a free, second end;

connecting means for at least physically connecting said free, second ends of respective pairs of adjacent ones of said piezoelectric elements to each other, for respective units of the fluid pump; and pressure chambers, each defined between said pairs of adjacent piezoelectric elements and between said stationary pump base and said connecting means, so that there are gaps between walls of said piezoelectric elements and walls of piezoelectric elements of adjacent units;

wherein, for each of said pairs of piezoelectric elements, a first, inner electrode is provided on an inner surface of at least one of said pair of piezoelectric elements, between which said pressure chamber is defined;

a second, outer electrode is provided on an outer surface of said at least one of said pair of piezoelectric elements, exterior to said pressure chamber; and one of said first and second electrodes is electrically connected to corresponding electrodes of adjacent units.

12. A piezoelectric fluid pump as set forth in claim 11, wherein said pressure chamber defining means comprises a unitary piezoelectric block having grooves which are formed by a mechanical process.

13. A piezoelectric fluid pump comprising:

a stationary pump base;

a plurality of piezoelectric elements arranged in parallel on said stationary pump base, each of said piezoelectric elements having in a direction perpendicular to a polarizing direction of said piezoelectric elements, a first end fixed to said stationary pump base and a free, second end;

connecting means for at least physically connecting said free, second ends of respective pairs of adjacent ones of said piezoelectric elements to each other, for respective units of the fluid pump; and pressure chambers, each defined between said pairs of adjacent piezoelectric elements and between said stationary pump base and said connecting means, so that there are gaps between walls of said piezoelectric elements and walls of piezoelectric elements of adjacent units;

wherein, for each of said pairs of piezoelectric elements, a first, inner electrode is provided on inner surfaces of said pair of piezoelectric elements, between which said pressure chamber is defined;

a second, outer electrode is provided on outer surfaces of said pair of piezoelectric elements; and material of said first and second electrodes are different to each other.

14. A piezoelectric fluid pump as set forth in claim 13, wherein said pressure chamber defining means comprises a unitary piezoelectric block having grooves which are formed by a mechanical process.

15. A piezoelectric fluid pump comprising:

a stationary pump base;

a plurality of piezoelectric elements arranged in parallel on said stationary pump base, each of said piezoelectric elements having in a direction perpendicular to a polarizing direction of said piezoelectric elements, a first end fixed to said stationary pump base and a free, second end;

connecting means for at least physically connecting said free, second ends of respective pairs of adjacent ones of said piezoelectric elements to each other, for respective units of the fluid pump; and pressure chambers, each defined between said pairs of adjacent piezoelectric elements and between said stationary pump base and said connecting means, so that there are gaps between walls of said piezoelectric elements and walls of piezoelectric elements of adjacent units;

wherein, for each of said pairs of piezoelectric elements, a first, inner electrode is provided on inner surfaces of said pair of piezoelectric elements, between which said pressure chamber is defined;

a second, outer electrode is provided on outer surfaces of said pair of piezoelectric elements; and a thickness of said first electrode is different from a thickness of said second electrode.

16. A piezoelectric fluid pump as set forth in claim 15, wherein said pressure chamber defining means comprises a unitary piezoelectric block having grooves which are formed by a mechanical process.

17. A piezoelectric fluid pump comprising:

a stationary pump base;

a plurality of piezoelectric elements arranged in parallel on said stationary pump base, each of said piezoelectric elements having, in a direction perpendicular to a polarizing direction of said piezoelectric elements a first end fixed to said stationary pump base and a free, second end;

connecting means for at least physically connecting said free, second ends of respective pairs of adjacent ones of said piezoelectric elements to each other, for respective units of the fluid pump; and pressure chambers, each defined between said pairs of adjacent piezoelectric elements and between said stationary pump base and said connecting means, so that there are gaps between walls of said piezoelectric elements and walls of piezoelectric elements of adjacent units;

wherein a piezoelectric block is subjected to slit-machining process or shape-extrusion molding process to form a plurality of units of the piezoelectric fluid pump including a plurality of thin grooves which constitute said pressure chambers and a plurality of said gaps alternately arranged; and free ends of piezoelectric elements which constitute walls of said thin grooves are covered by a plate member having fluid outlet ports or inlet ports.

18. A piezoelectric fluid pump as set forth in claim 17, wherein said piezoelectric block has at least one end surface, on which a transverse slit is provided along a direction perpendicular to said intermediate slits;

at least said inner surfaces of the gaps and said end surface of the piezoelectric block are plated with said conductive thin film;

said end surface of the piezoelectric block is polished so that the plated thin conductive film thereon is removed, thus said first, inner electrodes are electrically isolated from said second, outer electrodes on outer walls of said pair of piezoelectric elements;

said second, outer electrodes of said pair of piezoelectric elements, between which said pressure chamber is defined, are electrically connected to each other through said plated thin conductive film formed in said transverse slit.

* * * * *